US007104292B2

(12) United States Patent
Wodjenski

(10) Patent No.: US 7,104,292 B2
(45) **Date of Patent: *Sep. 12, 2006**

(54) AUTO-SWITCHING SYSTEM FOR SWITCH-OVER OF GAS STORAGE AND DISPENSING VESSELS IN A MULTI-VESSEL ARRAY

(75) Inventor: Michael J. Wodjenski, New Milford, CT (US)

(73) Assignee: Advanced Technology Materials, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/253,143

(22) Filed: Oct. 18, 2005

(65) Prior Publication Data

US 2006/0032550 A1 Feb. 16, 2006

Related U.S. Application Data

(63) Continuation of application No. 10/658,035, filed on Sep. 9, 2003, now Pat. No. 6,955,198.

(51) Int. Cl.
*B65B 1/04* (2006.01)

(52) U.S. Cl. ..... 141/248; 141/103; 141/104; 141/99

(58) Field of Classification Search ..... 141/248, 141/234, 103, 104, 99; 222/265, 278, 280; 137/240; 134/95.1, 98.1
See application file for complete search history.

(56) References Cited

U.S. PATENT DOCUMENTS

| | | | | |
|---|---|---|---|---|
| 5,518,528 | A | 5/1996 | Tom et al. | |
| 5,865,205 | A * | 2/1999 | Wilmer | 137/2 |
| 6,012,478 | A * | 1/2000 | Park | 137/240 |
| 6,089,027 | A | 7/2000 | Wang et al. | |
| 6,101,816 | A | 8/2000 | Wang et al. | |
| 6,302,139 | B1 * | 10/2001 | Dietz | 137/240 |
| 6,343,476 | B1 | 2/2002 | Wang et al. | |
| 6,581,623 | B1 * | 6/2003 | Carpenter et al. | 137/113 |

* cited by examiner

*Primary Examiner*—Khoa D. Huynh
(74) *Attorney, Agent, or Firm*—Vincent K. Gustafson; Intellectual Property/Technology Law; Maggie Chappuis

(57) ABSTRACT

A gas storage and dispensing system, including multi-vessel arrays of gas dispensing vessels that require successive change-over to provide ongoing supply of gas to a gas-consuming process, with a pump coupled in gas flow communication with the array. The system is provided with capability for time delay auto-switchover sequencing of the switchover operation in which an endpoint limit sensing of an on-stream gas dispensing vessel is responsively followed by termination of gas flow to the pump, inactivation of the pump, autoswitching of vessels, reinitiation of gas flow to the pump and reactivation of the pump. The system minimizes the occurrence of pressure spikes at the pump outlet in response to pressure variation at the pump inlet incident to switchover of gas supply from one vessel to another in the multi-vessel array.

20 Claims, 17 Drawing Sheets

MAIN MENU

| | |
|---|---|
| ACCESS CODE ENTRY | STATUS SCREEN |
| CURRENT ALARMS | MAINTENANCE MENU |
| ALARM HISTORY | AUTO SWITCH OVER |
| SYSTEM IDLE | |

FIG.3

LEFT CYLINDER MENU

| | |
|---|---|
| TOOL EVACUATION | GAS ON |
| TOOL PURGE | LOCAL EVACUATION |
| TOOL PUMP PURGE | LOCAL PUMP PURGE |
| CYLINDER CHANGE | MAIN MENU |

FIG.4

AUTO-SWITCHING SYSTEM FOR SWITCH-OVER OF GAS STORAGE AND DISPENSING VESSELS IN A MULTI-VESSEL ARRAY

CROSS-REFERENCE TO RELATED APPLICATION

This is a continuation of U.S. patent application Ser. No. 10/658,035 filed Sep. 9, 2003 in the name of Michael J. Wodjenski, issued Oct. 18, 2005 as U.S. Pat. No. 6,955,198.

FIELD OF THE INVENTION

The present invention relates generally to gas storage and dispensing vessels, and particularly to multi-vessel arrays that require successive change-over to provide ongoing supply of gas to a gas-consuming process unit. In a specific aspect, the invention relates to a gas cabinet containing multiple gas storage and dispensing vessels providing gas to semiconductor manufacturing tools in a semiconductor manufacturing facility, and to auto-switching systems for switch-over of vessels to maintain continuity of gas dispensing operation.

DESCRIPTION OF THE RELATED ART

The physical adsorbent-based gas storage and dispensing system disclosed in Tom et al. U.S. Pat. No. 5,518,528 has revolutionized the transportation, supply and use of hazardous gases in the semiconductor industry. The system includes a vessel holding a physical adsorbent medium such as molecular sieve or activated carbon, having sorptive affinity for the gas that is to be stored in and selectively dispensed from the vessel. The gas is held in the vessel in an adsorbed state on the sorbent medium at reduced pressure relative to a corresponding empty (of sorbent) vessel holding an equivalent amount of gas in the "free" (unadsorbed) state. Advantageously, the interior gas pressure in the storage and dispensing vessel is at sub-atmospheric pressure, or atmospheric or low superatmospheric pressure.

By such reduced pressure storage, the safety of the gas storage and dispensing operation is substantially improved, since any leakage will result in a very low rate of egress of gas into the ambient environment, relative to a conventional high-pressure gas storage cylinder. Further, the low pressure operation of the adsorbent-based system, is associated with a lower likelihood of such gas leakage events, since the reduced pressure reduces the stress and wear on system components such as valves, flow controllers, couplings, joints, etc.

In application to semiconductor manufacturing operations, the gas storage and dispensing vessels of the foregoing type are frequently deployed in gas cabinets, in which a plurality of vessels is manifolded to appropriate flow circuitry, e.g., including piping, valves, restricted flow orifice elements, manifolds, flow regulators, mass flow controllers, purge loops, instrumentation and monitoring equipment, etc. Such flow circuitry may be associated with automatic switching systems that permit a gas storage and dispensing vessel to be taken off-stream when it is exhausted of gas or otherwise approaching empty status, e.g., by appropriate switching of valves, so that the exhausted or otherwise substantially depleted vessel is isolated from gas feed relationship with the flow circuitry, to facilitate change-out of the vessel. Concurrently, a full gas storage and dispensing vessel is switched on, e.g., by appropriate switching of flow control valves in a manifold to place such fresh vessel into gas feed relationship with the flow circuitry. The isolated depleted vessel then can be uncoupled from the flow circuitry and removed from the gas cabinet, to enable installation of a full vessel for subsequently switch-over usage of such vessel during the ensuing operation when the previously switched-on vessel has become depleted of gas.

In addition to the gas storage and dispensing vessels of the foregoing type as described in Tom et al. U.S. Pat. No. 5,528,518, commercialized by ATMI, Inc. (Danbury, Conn., USA) under the trademarks SDS® and SAGE®, fluid storage and dispensing vessels described in U.S. Pat. Nos. 6,101,816; 6,089,027; and 6,343,476 issued to Luping Wang, et al. and commercially available from ATMI, Inc. (Danbury, Conn., USA) under the trademark VAC are likewise deployed in gas cabinets in semiconductor manufacturing facilities and require periodic switching to maintain continuity of gas dispensing operation. The VAC® vessels feature a fluid pressure regulator that is disposed upstream of a flow control element such as a flow control valve, whereby gas dispensed from the vessel is dispensed at a set point pressure determined by the regulator. The fluid in the VAC® vessel can be a high-pressure liquid or gas that is confined against the regulator, as a source of gas for the semiconductor process. The regulator can be interiorly disposed in the vessel to protect the regulator against impact or environmental contamination, and the vessel may in specific embodiments contain physical adsorbent material for desorptive dispensing of gas from the vessel. By providing the regulator with a set point pressure level that is sub-atmospheric, atmospheric or low superatmospheric pressure, the same operating and safety advantages are realized as described hereinabove in connection with the gas storage and dispensing vessels of U.S. Pat. No. 5,518,528.

Vessels of the foregoing type, commercialized under the SDS®, SAGE® and VAC® trademarks, when employed to contain fluid at low pressures, produce gas that in many applications must be boosted in pressure to render the gas amenable to subsequent usage. In such instances, an extractor system can be utilized to extract gas from the vessel. The extractor system includes an extraction pump and a surge tank, along with controls and safety systems essential to the safe operation of the gas supply arrangement. The extractor system is housed in an exhausted and monitored metal enclosure, with gas delivery hardware being housed in a main cabinet, and control electronics being located in a separate enclosure that may for example be mounted on the top of the main cabinet. Multiple gas storage and dispensing vessels can be contained in a separate dedicated gas cabinet containing gas delivery hardware, as a reduced pressure module with which the extractor system can be coupled to provide constant pressure delivery of gas to a semiconductor tool operating at mild vacuum conditions. The reduced pressure module may contain heating capability to heat the gas dispensing vessels to facilitate the dispensing operation.

In the reduced pressure module, the gas dispensing hardware and electronics can be programmably arranged to effect automatic vessel changeover at a preset pressure, when a first vessel reaches a point of depletion at which it is no longer able to maintain the preset pressure. For such purpose, the gas dispensing hardware and electronics can be constructed and arranged for automated or manual evacuation, purging and leak detection of the gas flow path. A programmable logic controller (PLC) can be used in the system for monitoring valve status, system pressures, vessel weights and temperatures, and for providing preprogrammed sequences for control of the following functions:

vessel change-out, initiating gas flow, auto-switchover of vessels, purge gas control, process/purge gas evacuation, securing process gas flow followed by shut-down, and temperature control of vessel heaters, e.g., heating blankets.

Reduced pressure modules and extractor systems of the above-described type are commercially available from ATMI, Inc. (Danbury, Conn., USA) under the trademark RPM.

Thus, vessels of the foregoing adsorbent-based and/or internal pressure regulator-equipped types can be deployed in multi-vessel arrays, in which automatic switch-over of vessels, from a depleted vessel to a full vessel, takes place when the end point of an active (on-stream) vessel is reached. The end point may be determined in various ways—it may be determined by a decline in dispensed gas pressure and/or flow rate indicative of depletion of the vessel contents, or it can be determined by weight loss of the vessel incident to continued dispensing of gas therefrom, or by cumulative volumetric flow of dispensed gas, or by predetermined operating time, or in other suitable manner.

Regardless of the means or mode of determining end point of the vessel, the automated switching from a depleted vessel to a full one involves a drastic change in pressure at the inlet of the pump that is employed as a motive fluid driver to effect flow of gas through the flow circuitry to the downstream gas-consuming process. The proportional integral derivative (PID) control logic that is employed with the pump in a usual arrangement cannot react quickly enough to slow the pump to avoid the impact of the pressure change, so that a pressure spike occurs as a result at the outlet of the fast running pump. In a sub-atmospheric pressure system, e.g., as employed for ion implantation in which sub-atmospheric operation of the implant chamber represents an optimal process arrangement, this pressure spike can cause pressure to exceed system set point limits. Such overpressure condition in turn can cause alarms to be actuated, and in an extreme pressure variation condition, the safety monitoring elements of the gas delivery system may cause shut-down of the gas flow and undesired stoppage of the downstream gas-consuming process.

It would therefore be an advance in the art to provide an automated switching apparatus and method for gas delivery systems comprising pumping/extractor apparatus coupled with multiple vessel arrays including vessels of the type described in the aforementioned U.S. Pat. Nos. 5,518,528; 6,101,816; 6,089,027; and 6,343,476, which minimize pressure perturbations incident to vessel switching.

SUMMARY OF THE INVENTION

The present invention relates generally to gas storage and dispensing vessels, and particularly to multi-vessel arrays that require successive change-over from an exhausted vessel to a fresh gas-containing vessel in the array, in order to provide ongoing supply of gas to a gas-consuming process.

The invention relates in one aspect to a gas supply and dispensing system, comprising:

an array of at least two gas storage and dispensing vessels arranged for sequential on-stream dispensing operation involving switchover from a first vessel to a second vessel in the array;

a pump coupled in gas flow communication with the array for pumping of gas derived from an on-stream one of the vessels in the array, and discharge of pumped gas;

an auto-switchover system constructed and arranged to sense an endpoint limit of the on-stream one of the vessels and to inititate auto-switching from the on-stream one of the vessels to another of the vessels in the array having gas therein, for subsequent dispensing of gas from said another of the vessels, as a subsequent on-stream vessel, wherein the auto-switchover system between sensing of the endpoint limit and initiating auto-switching terminates flow of gas to the pump and inactivates the pump; and wherein the auto-switchover system after initiating auto-switching reinitiates flow of gas to the pump and reactivates the pump.

In another aspect, the invention relates to a method of substantially reducing pressure variation of pumped gas discharged from a pump in a gas supply and dispensing system comprising an array of at least two gas storage and dispensing vessels arranged for sequential on-stream dispensing operation involving switchover from a first vessel to a second vessel in the array, wherein the pump is coupled in gas flow communication with the array for pumping of gas derived from an on-stream one of the vessels in the array, and discharge of pumped gas, such method comprising:

sensing an endpoint limit of the on-stream one of the vessels and switching from the on-stream one of the vessels to another of the vessels in the array having gas therein, for subsequent dispensing of gas from said another of the vessels, as a subsequent on-stream vessel, terminating flow of gas to the pump and inactivating the pump, wherein said terminating and inactivating steps are conducted between the step of sensing of the endpoint limit and the switching step; and reinitiating flow of gas to the pump and reactivating the pump, wherein said reinitiating and reactivating steps are conducted after the switching step.

Other aspects, features and embodiments of the present invention will be more fully apparent from the ensuing disclosure and appended claims.

BRIEF DESCRIPTION OF THE DRAWINGS

FIG. 3 is the "MAIN MENU" screen display for the reduced pressure module of FIG. 1.

FIG. 4 is the "LEFT CYLINDER MENU" screen display for the reduced pressure module of FIG. 1.

DETAILED DESCRIPTION OF THE INVENTION, AND PREFERRED EMBODIMENTS THEREOF

The disclosure of U.S. patent application Ser. No. 10/658,035 filed Sep. 9, 2003 in the name of Michael J. Wodjenski is hereby incorporated herein by reference, in its entirety, for all purposes.

The present invention provides an automated switching apparatus and method for gas delivery systems in which pumping/extractor apparatus is coupled with multiple vessel arrays including vessels of the type described in the aforementioned U.S. Pat. Nos. 5,518,528; 6,101,816; 6,089,027; and 6,343,476.

The present invention is based on the discovery that the adverse pressure effects of switch-over of fluid storage and dispensing vessels in a multi-vessel array can be eliminated by the provision of a time delay in the automated change-over system, to allow the pumping components to be signaled in advance of the automated change-over, so that the pumping components responsively operate to prevent the transmission of a pressure spike to the inlet of a fast-running pump that is employed to effect flow of gas through the flow circuitry to the downstream gas-consuming process.

Figure 1:
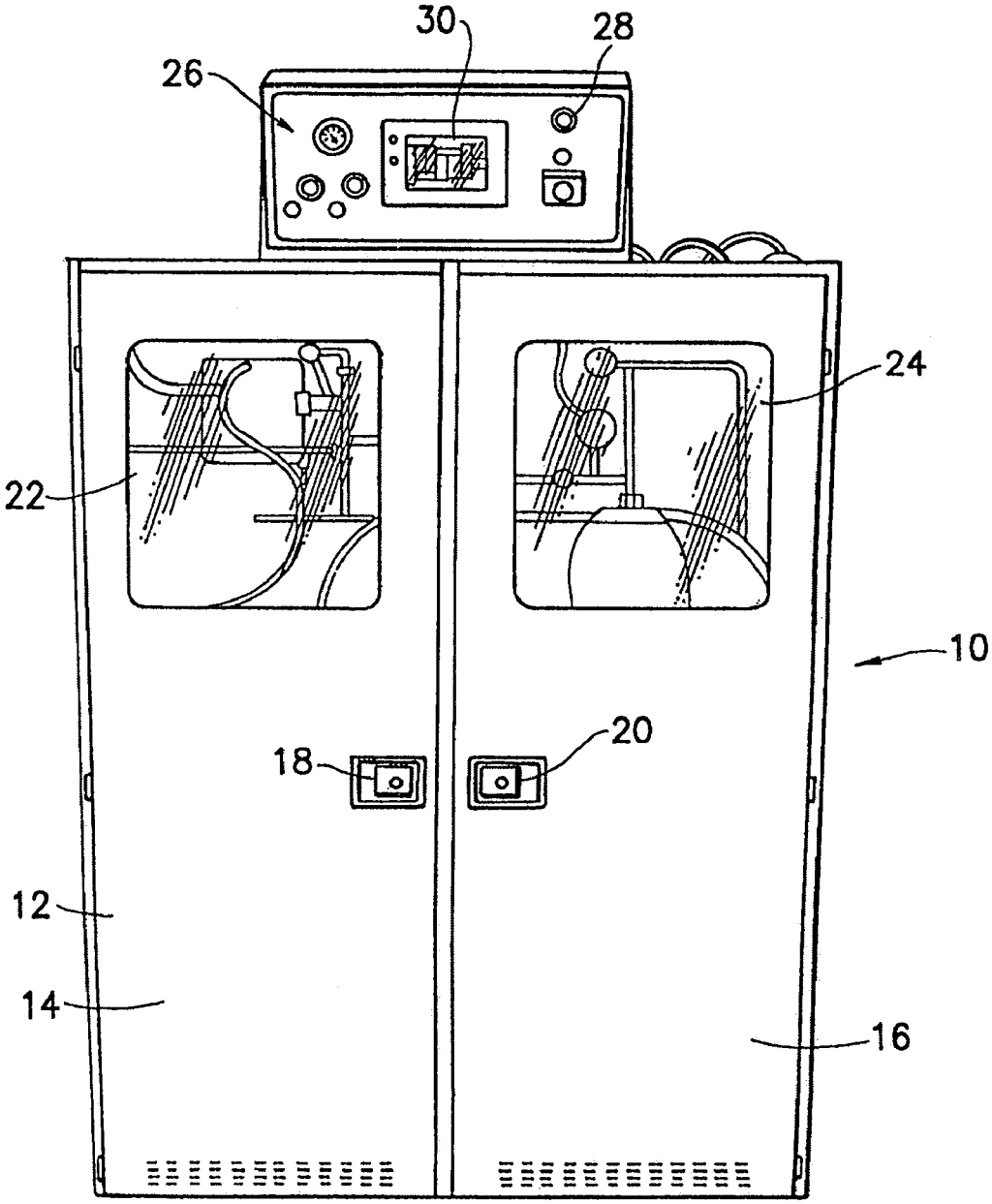
FIG. 1 is a front view of a reduced pressure module gas delivery system with vessel switchover capability according to one embodiment of the invention.

FIG. 1 is a front view of a reduced pressure module gas delivery system 10 with vessel switchover capability according to one embodiment of the invention.

The gas delivery system 10 is comprised of a main cabinet 12 as a primary enclosure, and an electronics enclosure 26, wherein the main cabinet and the electrical enclosure are bolted together to form the integrated gas delivery system. A gas supply manifold and the gas supply vessels are housed within the main cabinet 12, which may for example be constructed of 12-gauge cold rolled steel. The main cabinet 12 features left hand door 14 with latch 18 and viewing window 22, and right hand door 16 with latch 20 and viewing window 24. The electronics enclosure 26, featuring on/off switch 28, is mounted on top of the main cabinet 12, as illustrated. A touch screen interface 30 is located on the front of the electrical enclosure on top of the cabinet.

The electronics enclosure 26 includes a programmable logic controller (PLC) for control of the integrated gas delivery system via the touch screen interface 30, with communication between the PLC unit and the touch screen being effected via a serial port connection on the PLC unit. The screen has a touch sensitive grid that corresponds to text and graphics and communicates commands to the PLC unit. The touch screen displays user menus, operational and informational screens and security barriers to facilitate only authorized access to the system.

The main cabinet 12 contains a pair of sorbent-holding gas storage and dispensing vessels, wherein the sorbent medium is provided in the form of a bed of particles of solid-phase physical sorbent having sorptive affinity for the gas in the vessel. In addition to the gas storage and dispensing vessels, the main cabinet contains the process flow circuitry, which also includes piping, valving, etc. for purge and venting operations.

The gas supply vessels, sometimes hereinafter referred to as cylinders, may be of any suitable type. Although illustratively described herein as solid-phase physical adsorbent-containing vessels having gas therein sorptively retained on the solid-phase physical adsorbent, e.g., a molecular sieve, activated carbon, silica, alumina, sorptive clay, macroreticulate polymer, etc., it is to be appreciated that the gas supply vessel may be of any other suitable type, in which is a fluid is held for dispensing of gas from the vessel. Gas supply vessels of the types variously described in the aforementioned U.S. Pat. Nos. 5,518,528; 6,101,816; 6,089,027; and 6,343,476 are presently preferred in the broad practice of the present invention, and the disclosures of such patents are hereby incorporated herein by reference in their respective entireties.

Figure 2:
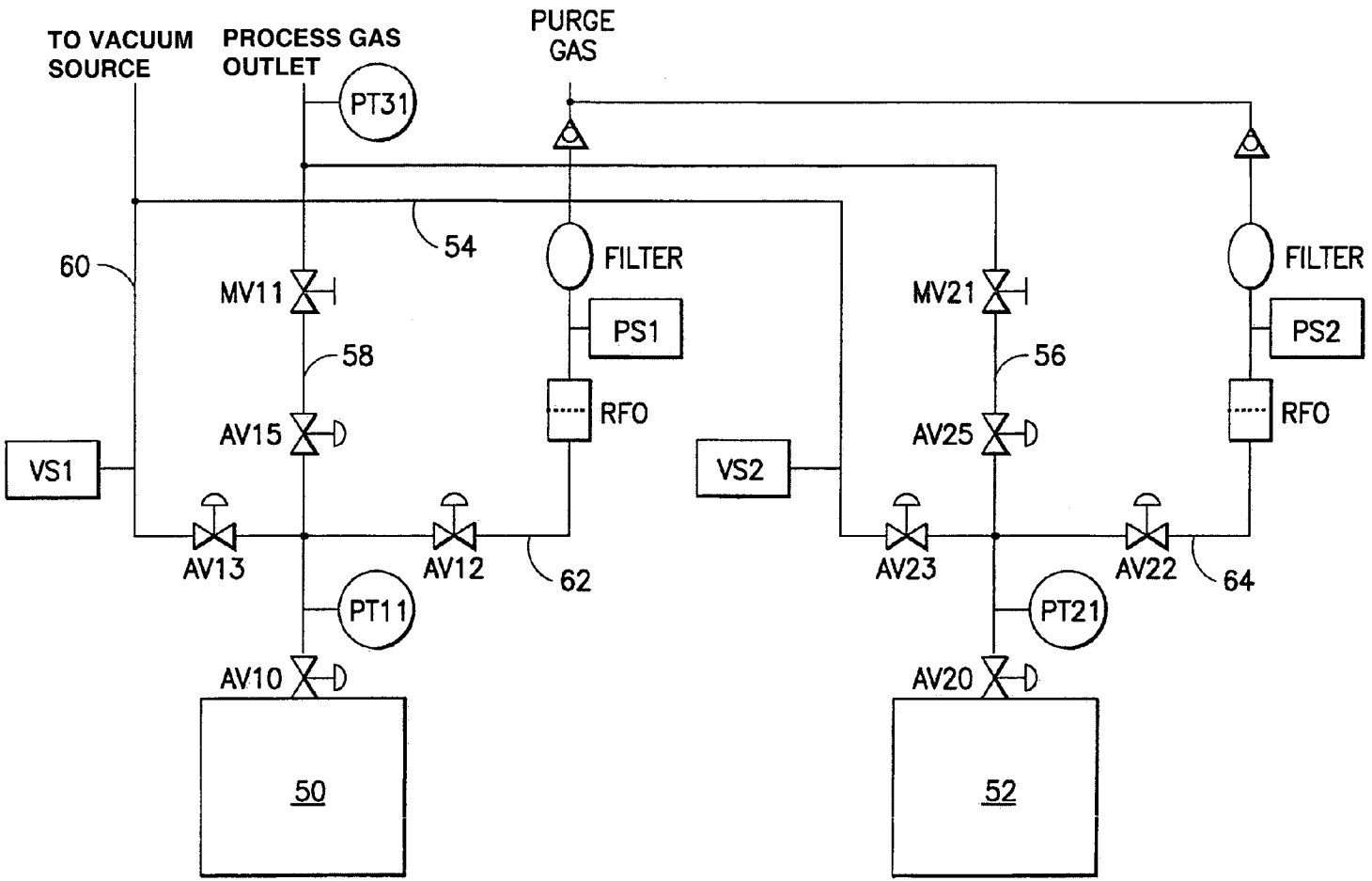
FIG. 2 is a schematic of the flow circuitry of the reduced pressure module of FIG. 1.

FIG. 2 is a schematic of the flow circuitry of the reduced pressure module of FIG. 1, including left gas storage and dispensing vessel 50 and right gas storage and dispensing vessel 52 interconnected with flow circuitry including manifold gas flow lines 54, 56, 58, 60, 62 and 64. The flow circuitry of this arrangement has been designed for high flow of sub-atmospheric pressure gas with low internal volume and minimal dead volume. There are four types of connections to the gas manifold flow circuitry: (i) a pump/scrubber-manifold connection; (ii) a process gas outlet-manifold connection, (iii) a purge gas-manifold connection and (iv) a gas supply vessel-manifold connection. Each of these is discussed in turn below.

In the pump/scrubber-manifold connection, a vacuum source (not shown in FIG. 2) is connected to a first end of vacuum source line 60 containing automatic flow control valve AV13 therein. Vacuum source line 60 is joined at a second end thereof to process gas outlet line 58.

In the process gas outlet-manifold connection, a downstream gas-consuming process unit (not shown in FIG. 2) is connected to a first end of process gas outlet line 58, containing manual valve MV11 and automatic valves AV15 and AV10 therein. The process gas outlet line 58 also has joined thereto process gas feed line 56, containing manual valve MV21 and automatic valves AV25 and AV20 therein.

In the purge gas-manifold connection, a source of purge gas (not shown in FIG. 2) is joined to purge gas feed line 62 at a first end thereof. The purge gas feed line 62 is joined at a second end thereof to the process gas outlet line 58. The purge gas feed line 62 contains a filter, pressure switch (PS1), a restricted flow orifice (RFO) and automatic valve AV12 therein. Joined to purge gas feed line 62 is a purge gas flow line 64, containing a filter, pressure switch (PS2), restricted flow orifice (RFO) and automatic valve AV22 therein. At its opposite end from the junction with purge gas feed line 62, the purge gas flow line 64 is joined to the process gas feed line 56.

In the gas supply vessel-manifold connection, the gas storage and dispensing vessel 50 is joined to the process gas outlet line 58, upstream of automatic valve AV10. The gas storage and dispensing vessel 52 is joined to process gas feed line 56 upstream of automatic valve AV20.

In the FIG. 2 manifold arrangement, three pressure transducers are located on the manifold. Pressure transducer PT-11 monitors the pressure associated with gas storage and dispensing vessel 50 and pressure transducer PT-21 monitors the pressure associated with gas storage and dispensing vessel 52. Pressure transducer PT-31 monitors the outlet pressure of the process gas as flowed to the downstream gas-consuming process unit, or to an extractor module interposed between the reduced pressure module and the downstream gas-consuming process unit. The vacuum levels from the pump/scrubber are monitored by vacuum sensor VS-1 in vacuum source line 60 on the portion of the manifold associated with gas storage and dispensing vessel 50, and by vacuum sensor VS-2 in process gas feed line 56 in the portion of the manifold associated with gas storage and dispensing vessel 52.

The source of purge gas that is joined to the purge gas feed line 62 to constitute the purge gas-manifold connection, may be any suitable purge gas source, such as a supply tank of a purge gas such as ultra-high purity nitrogen or ultra-high purity nitrogen/helium mixture, or other suitable single component or multi-component gas medium, as effective for the purging of the flow passages of the manifold lines and associated componentry. So-called "house nitrogen" (i.e., nitrogen available from the general supply utility in the semiconductor manufacturing facility) or clean dry air (CDA) from a suitable source thereof may be employed to actuate pneumatic automatic valves in the manifold, and to purge the main cabinet of the reduced pressure module as well as the associated electronics module. Gas is exhausted from the main cabinet by means of ducting coupled to the main cabinet and joined to the exhaust system of the semiconductor manufacturing facility.

The operation of the reduced pressure module will now be described with reference to a series of screens displayed on the touch screen of the electronics module associated with the main cabinet of the reduced pressure module.

In an initial operation, depressing the START button 28 (see FIG. 1) will begin the start up sequence of events for the system leading to the initial MAIN MENU screen shown in FIG. 3, including touch selections for "ACCESS CODE ENTRY," "STATUS SCREEN," "CURRENT ALARMS," "MAINTENANCE MENU," "ALARM HISTORY," "AUTO SWITCH OVER," and "SYSTEM IDLE."

Touch selection of "CURRENT ALARMS" from the MAIN MENU screen will generate a sub-menu for selection of alarm settings, e.g., silencing audible alarms, resetting system alarms that are not active so that they are reactivated, etc. and displaying current status of all alarms in the system.

After the alarms have been set as desired, a return to the MAIN MENU will permit access code entry by touch selection of "ACCESS CODE ENTRY," which generates a sub-menu allowing selection of the access level desired, including operational access, maintenance access, and total access. Level selection on the access level sub-menu then generates a keypad for access code entry.

Upon return to the MAIN MENU screen (FIG. 3), touch selection of the "MAINTENANCE MENU" (discussed more fully hereinafter in connection with FIG. 6 hereof) accesses an automated gas supply vessel change routine that can be utilized to install gas supply vessels at start-up, which begins with selection of the side (left-hand side or right-hand side of the cabinet) on which the initial gas supply vessel is to be installed. If the left-hand side gas supply vessel is to be installed, the corresponding selection on the touch screen will generate the "LEFT CYLINDER MENU" shown in FIG. 4. The "RIGHT CYLINDER MENU" is of a same format.

The "LEFT CYLINDER MENU" as shown in FIG. 4 includes touch selections for "TOOL EVACUATION," "GAS ON," "TOOL PURGE," "LOCAL EVACUATION," "TOOL PUMP PURGE," "LOCAL PUMP PURGE," "CYLINDER CHANGE," and "MAIN MENU."

Figure 5:
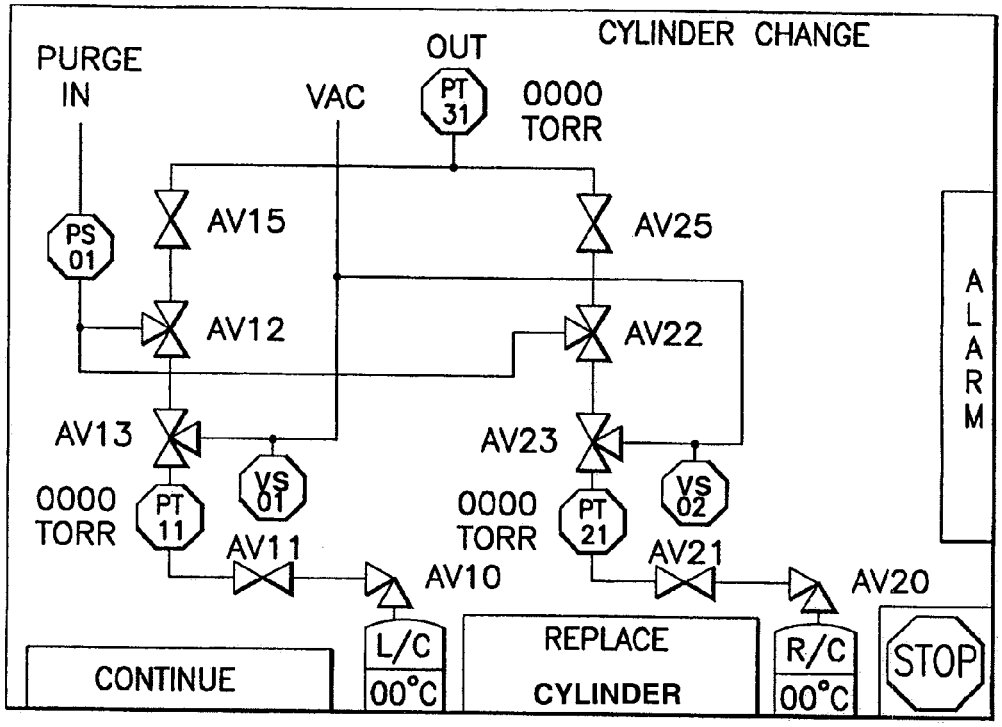
FIG. 5 is a gas supply vessel change screen display for the reduced pressure module of FIG. 1.

Pressing the "CYLINDER CHANGE" button on the touch screen will actuate the gas supply vessel change routine and generate the screen display shown in FIG. 5 with a prompt, "Replace Cylinder," denoting that the left-hand gas supply vessel can be installed in the main cabinet. After a filled gas supply vessel has been installed in the left bay of the main cabinet of the reduced pressure module, touch selection of "Continue" at the lower left-hand portion of the screen will cause the system to complete the cylinder change routine, and deploy the installed gas supply vessel for gas dispensing operation. The process then can be repeated in corresponding fashion for the right-hand gas supply vessel installation.

The reduced pressure module allows delivery and control of sub-atmospheric pressure gas from two gas supply vessels to a single outlet connection, in the embodiment shown in FIG. 1. The system is constructed and arranged to control automatic switchover from the starting gas supply vessel to the back-up gas supply vessel upon depletion of the starting gas supply vessel. After replacing the depleted cylinder, the system can be reset to autoswitch back to the original starting side.

As discussed hereinabove, the control system has two operational sub-menus, "LEFT CYLINDER" and "RIGHT CYLINDER" for the respective left-hand and right-hand gas supply vessels. These sub-menus are accessed through the MAIN MENU of the touch screen by pressing the MAINTENANCE MENU button to generate the screen shown in FIG. 6, which includes touch selections for "L/C MAINTE- NANCE MENU," "R/C MAINTENANCE MENU," "ANALOG CALIBRATION," "MANUAL CONTROL," "CURRENT ALARMS," "OPERATING PARAMETERS" and "MAIN MENU," wherein "L/C" means Left Cylinder and "R/C" means Right Cylinder. Selection of "MANUAL CONTROL" or "I/C MAINTENANCE MENU" or "R/C MAINTENANCE MENU" then permits "GAS ON" and maintenance operations to be selected (see FIG. 4).

The reduced pressure module in an illustrative embodiment has six (6) basic modes of operation, comprising:

1. All Valves Closed: at start-up, following a fatal alarm or power down/power failure, gas off on both cylinders.
2. Gas On Left Cylinder—Auto Switchover Off: runs to depletion of the Left cylinder, sends "Cylinder Empty" signal.
3. Gas On Right Cylinder—Auto Switchover Off: runs to depletion of the Right cylinder, sends "Cylinder Empty" signal.
4. Gas On Left Cylinder—Auto Switchover On: runs to depletion of the Left cylinder, switches to the Right cylinder.
5. Gas On Right Cylinder—Auto Switchover On: runs to the depletion of the Right cylinder, switches to the Left cylinder.
6. Manual Operation: manual selection of all valves except the cylinder valves.

The reduced pressure module can be fitted with manual gas supply vessel valves or with pneumatic gas supply vessel valves, with the selection of valve type being made in the parameter set-up operation.

Figure 7:
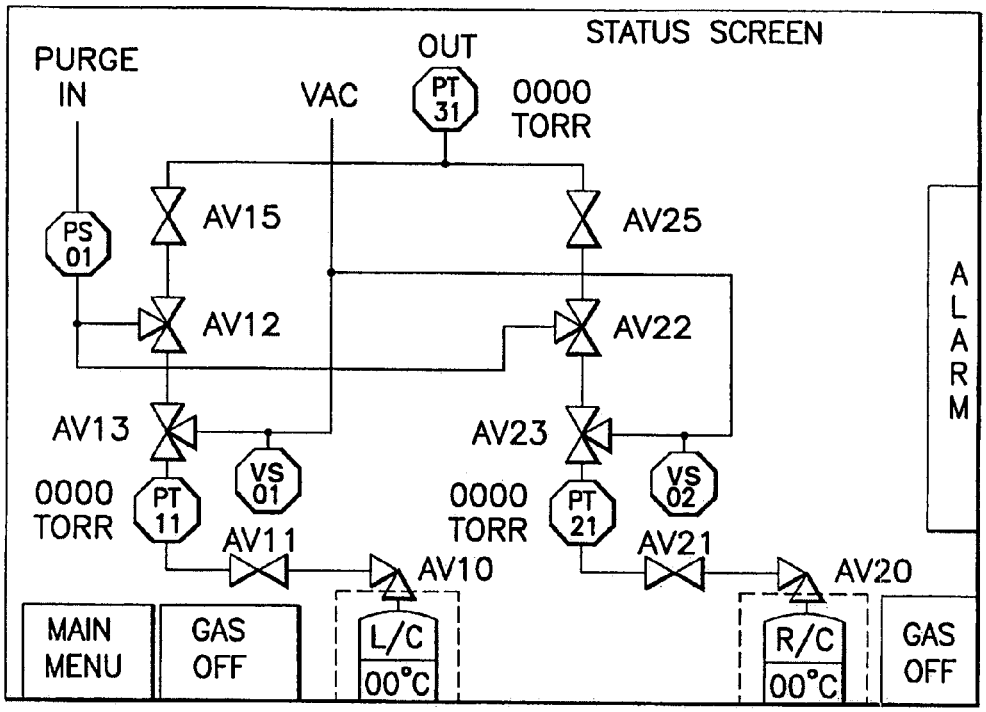
FIG. 7 is a screen display of the "STATUS SCREEN" for the reduced pressure module of FIG. 1, displaying the status of all valves in the reduced pressure module, the "GAS ON" or "GAS OFF" state of each gas supply vessel in the reduced pressure module, the pressure reading of each pressure transducer in the reduced pressure module, and the temperature of each of the gas supply vessels.

The "STATUS SCREEN" is shown in FIG. 7 and is accessed by corresponding touch screen selection on the "MAIN MENU." The "STATUS SCREEN" displays the status of all valves in the reduced pressure module, e.g., by a suitable color scheme (red coloration of the corresponding valves denoting closed valves, and green coloration of corresponding valves denoting open valves), or other visually perceptible differentiation. The "STATUS SCREEN" also displays the "GAS ON" or "GAS OFF" state of each gas supply vessel in the reduced pressure module, the pressure reading, e.g., in units of torr, of each pressure transducer in the reduced pressure module, and the temperature of each of the gas supply vessels. Gas flow in the reduced pressure module may be turned off from the "STATUS SCREEN."

The system is arranged so that a local evacuation must be run at the specific one of the left or right sides of the manifold flow circuitry at which gas is to be dispensed in a "GAS ON" mode. This local evacuation function is actuated by touch selection of the "LOCAL EVACUATION" button on the appropriate (left or right) gas supply vessel menu ("LEFT CYLINDER MENU" or "RIGHT CYLINDER MENU"). The "AUTO SWITCH OVER" button on the "MAIN MENU" is accessed and the autoswitch function is inactivated before the local evacuation and gas flow steps are initiated.

Figure 8:
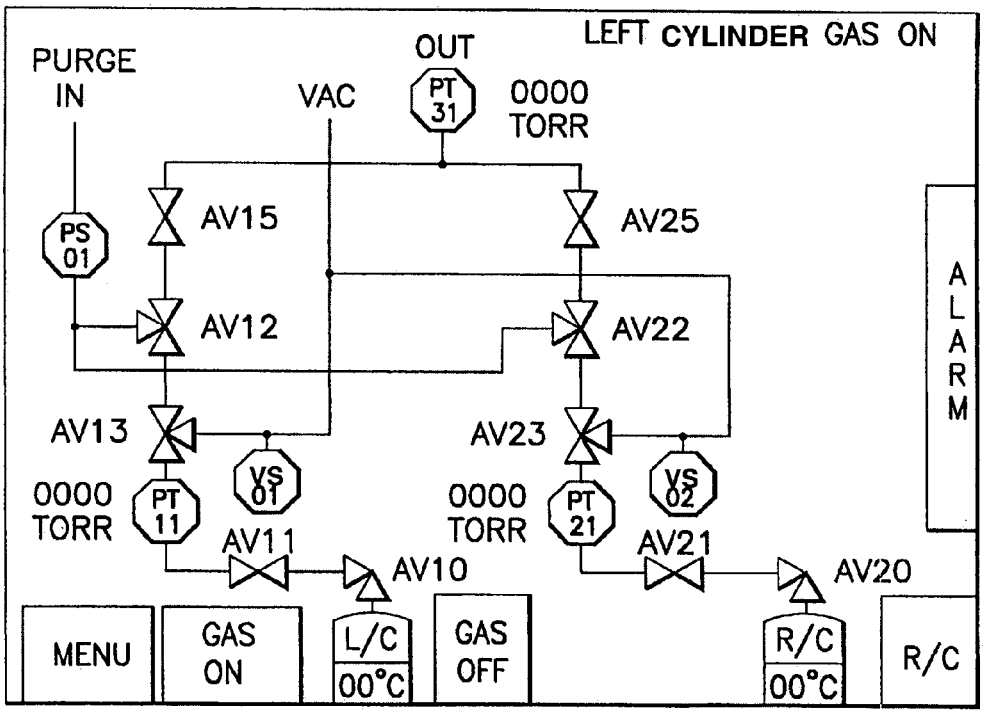
FIG. 8 is a "Left Cylinder Gas On" screen display for the reduced pressure module of FIG. 1.

Subsequent to local evacuation, the "GAS ON" button is touch selected on the appropriate (left or right) gas supply vessel menu ("LEFT CYLINDER MENU" or "RIGHT CYLINDER MENU"). This action generates the screen shown in FIG. 8 for the left-hand gas supply vessel, if the left-hand vessel is selected, or a corresponding screen for the right-hand gas supply vessel, if the right-hand vessel is selected, and opens the gas supply vessel valve (AV-10 or AV-20) if "Pneumatic Cylinder Valve" is selected, or a prompt the user to open the manual gas supply vessel valve if "Manual Cylinder Valve" is selected (screens not shown). The pigtail valve (AV-11 or AV-21) and tool isolation valve (AV-15 or AV-25) will also be opened, charging the manifold and delivery line with sub-atmospheric gas.

To set up the system for Auto Switchover, the "AUTO SWITCH OVER" screen is accessed on the "MAIN MENU" and an "AUTO SWITCHOVER" button (screen not shown) is pressed, following which the operator exits the screen, and returns to the "GAS ON" screen button for the gas supply vessel that is opposite the one previously turned on, i.e., the "GAS ON" button on the "RIGHT CYLINDER MENU" is selected if the left-hand gas supply vessel is the one that was previously active in the dispensing mode, and vice versa. By pressing the "GAS ON" button for such previously inactive gas supply vessel, the gas supply vessel valve (AV-10 or AV-20) will open as well as the pigtail valve (AV-11 or AV-21). The "stick" isolation valve (AV-15 or AV-25) will not open until the Auto Switchover point has been reached.

The "GAS OFF" condition can be controlled by either the "STATUS SCREEN" in the "MAIN MENU" or in the "GAS ON" screen of the appropriate "LEFT CYLINDER MENU" or "RIGHT CYLINDER MENU." Pressing the "GAS OFF" button will close all valves on the gas supply vessel side that is selected (valves AV-10, AV-11, and AV-15 on the left side, and valves AV-20, AV-21 and AV-25 on the right side), stopping the flow of gas from the gas supply vessel to the manifold and from the manifold to the tool delivery line. By pressing the Left or Right cylinder icons, the operator can toggle back and forth between the respective gas supply vessels. If the "Auto Switchover" setting were active, then turning the current "GAS ON" cylinder to "GAS OFF" will initiate an Auto Switchover. This is prevented from occurring by turning off the standby gas supply vessel first, and then turning off the active gas supply vessel. Following "GAS OFF" establishment, the manifold lines will still be charged with sub-atmospheric pressure gas until purged or evacuated.

The "CURRENT ALARMS" screen on the electronics module can be actuated to display all active alarms, and afford the operator the opportunity to reset alarm conditions, or to suppress one or more types of alarm, and to view the alarm history of the system, by frequency and by occurrence. The alarms may for example be actuated for the following alarm conditions: cabinet ventilation failure; door interlock alarm; toxic gas detection; insufficiency of vacuum/pressure; vacuum differential; and illegal analog input. The electronics module can also have monitoring devices, e.g., sensors and detectors, coupled to it, and operatively associated with the alarms, so that an alarm is actuated for example if a toxic gas monitor senses the presence of a gas species that is hazardous in character, and valves are actuated to close (e.g., AV-15 or AV-25) and to subsequently reopen when the alarm-triggering condition is terminated or resolved.

Figure 6:
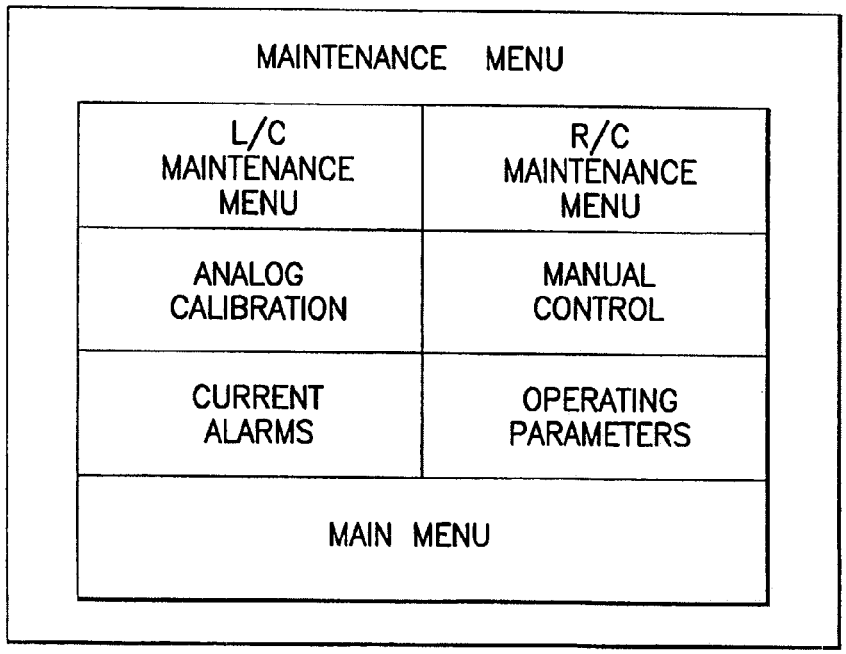
FIG. 6 is a screen display of the "MAINTENANCE MENU" for the reduced pressure module of FIG. 1, which includes touch selections for "L/C MAINTENANCE MENU," "R/C MAINTENANCE MENU," "ANALOG CALIBRATION," "MANUAL CONTROL," "CURRENT ALARMS," "OPERATING PARAMETERS" and "MAIN MENU," wherein "L/C" means Left Cylinder and "R/C" means Right Cylinder.

Pressing the "MAINTENANCE MENU" button on the "MAIN MENU" elicits the screen shown in FIG. 6, allowing the operator to select the left side or the right side maintenance operations, by touch selection of the alternative "L/C MAINTENANCE MENU" and "R/C MAINTENANCE MENU" buttons, which in turn accesses the respective "TOOL EVACUATION," "TOOL PURGE," "TOOL PUMP PURGE," "LOCAL EVACUATION," "LOCAL PUMP PURGE," "CYLINDER CHANGE" and "GAS ON" buttons on the maintenance menu for the respective side (and gas supply vessel) of the main cabinet.

Figure 9:
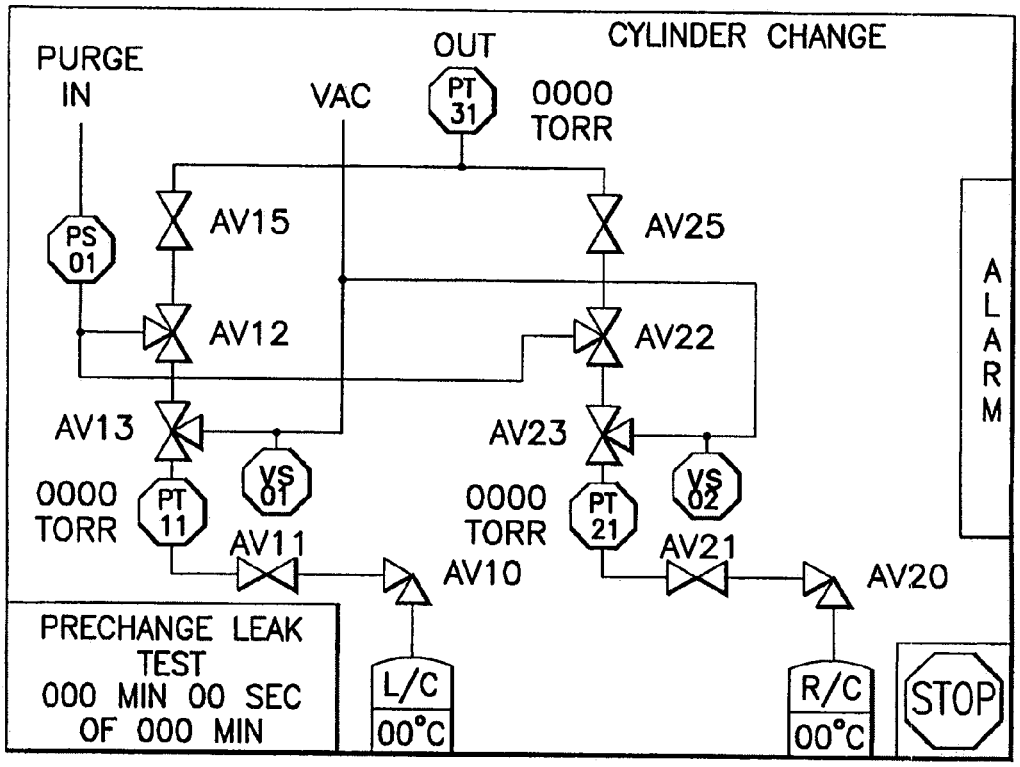
FIG. 9 is a PreChange Leak Test screen display for the reduced pressure module of FIG. 1, showing a schematic depiction of the gas panel, including valve states and pressure transducer pressure level, as well as the elapsed time and the total time of the Leak Test.

If the "CYLINDER CHANGE" button is pressed, the first cylinder change screen shown in FIG. 9 is accessed, which is the screen for the PreChange Leak Test. The PreChange Leak Test screen shows a schematic depiction of the gas panel, including valve states and pressure transducer pressure level. At the bottom of the PreChange Leak Test screen is a display of the elapsed time and the total time of the Leak Test.

The program next prompts the operator to turn the gas supply vessel lock-out switch to "off" and to lock the automatic gas supply vessel valve in the closed position and then to press "Enter." Once "Enter" has been pressed the purge inlet pressure is checked at pressure sensor PS-01. If there is sufficient pressure, automatic valve AV-12 is opened and the pressure is verified at pressure transducer PT-11. If the purge pressure is determined to be insufficient during these two steps, then the system will alarm and wait for operator input. Automatic valve AV-11 will open to pressurize the "stick" (portion of the manifold associated with a given vessel) up to the gas supply vessel valve. After a short delay, automatic valve AV-12 closes, the pressure value is captured and the pressure leak-down test timer starts. If the leak-down rate is less than the value in the set-up table, the leak test will conclude successfully. Upon successful completion of the leak test, the Local Purge Cycle screen will appear.

Figure 10:
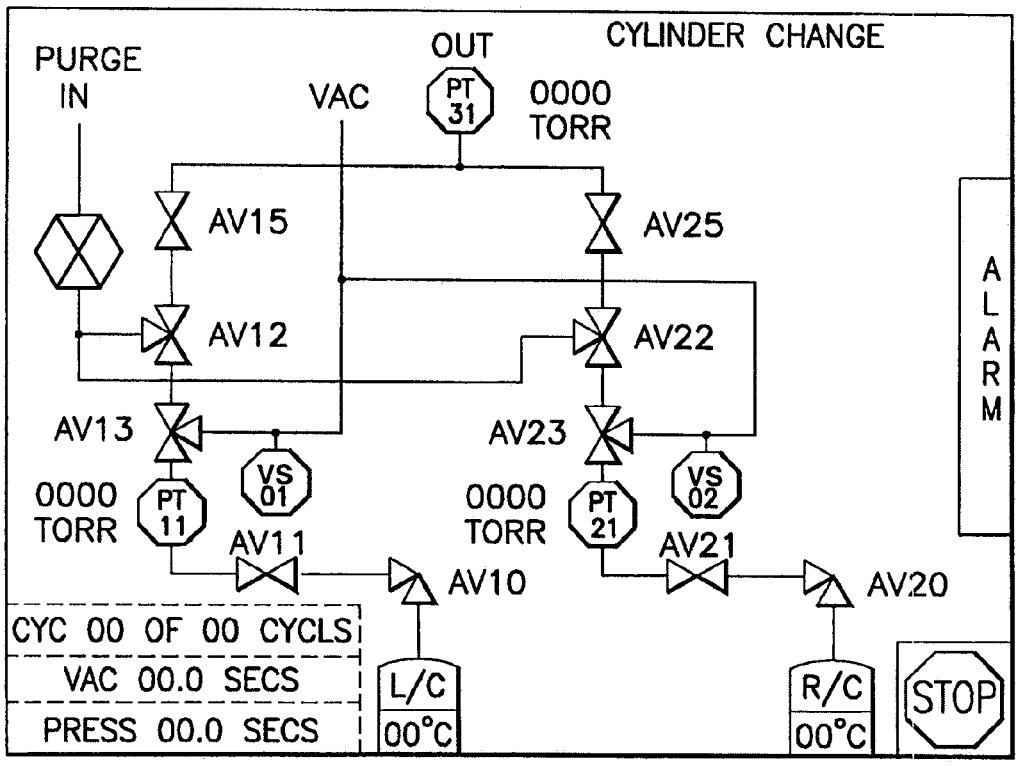
FIG. 10 is a Local Purge Cycle screen display for the reduced pressure module of FIG. 1.

The second cylinder change screen is the Local Purge Cycle screen, and is shown in FIG. 10. To start the local purge cycle, automatic valve AV-15 opens, and the vacuum level is checked at vacuum sensor VS-01. Once the vacuum sensor is satisfied and responsively closes, the vent isolation valve AV-13 is opened and the vacuum level at pressure transducer PT-11 is compared to the value in the set-up parameters of the system. When the sensed pressure of the pressure transducer PT-11 is below the pre-programmed vacuum level, the vent valve, AV-13, is closed and the purge valve, AV-12, is opened, thereby pressurizing the gas stick to the preset purge gas pressure. The above sequence is repeated for the number of cycles established in the set-up routine in the system program. After completing the cycles, the next screen in the Cylinder Change procedure is displayed.

Figure 11:
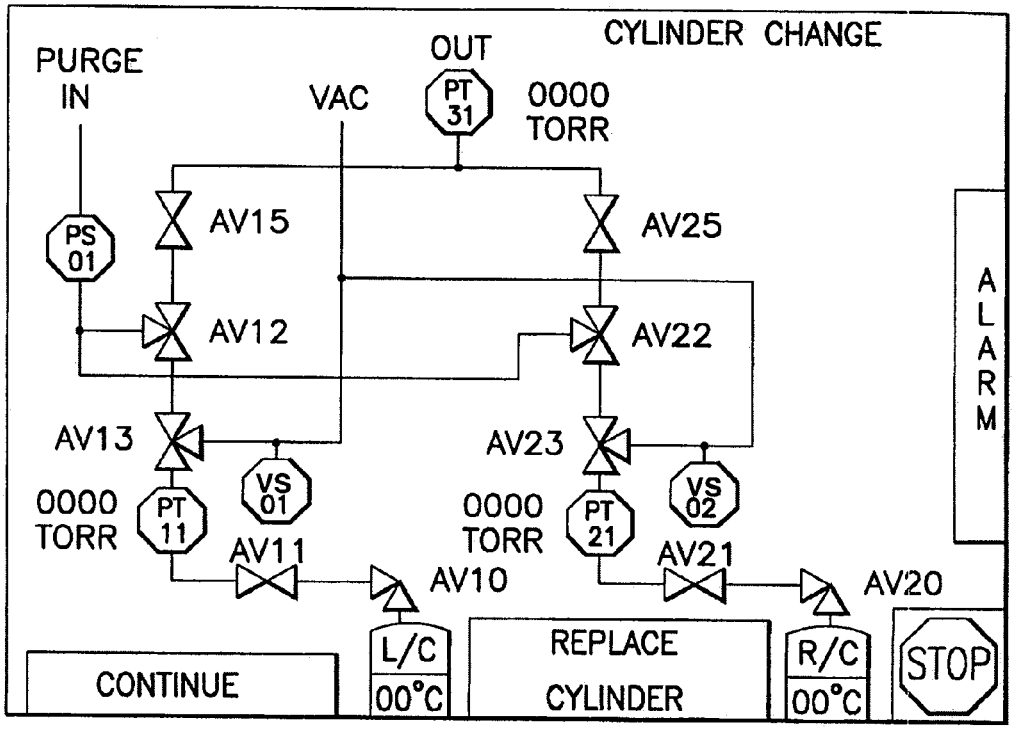
FIG. 11 is a cylinder change screen display for the reduced pressure module of FIG. 1.

The third of the cylinder change screens is shown in FIG. 11, and instructs the operator to replace the cylinder. Upon breaking the CGA fitting associated with the gas supply vessel being changed out, a nitrogen purge will flow out of the open pigtail portion of the manifold to prevent backflow of air into the pigtail. When the new gas supply vessel has been installed and the CGA fitting tightened to the appropriate torque, the Continue button is pressed, thereby generating the screen shown in FIG. 12.

Figure 12:
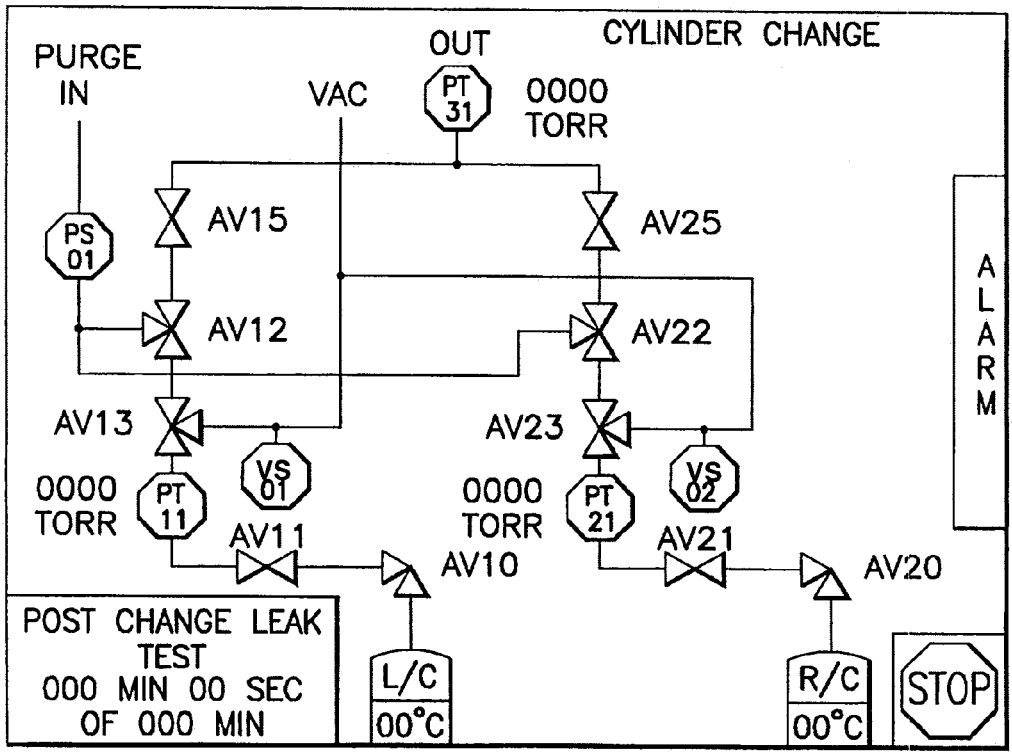
FIG. 12 is a Post Cylinder Change Leak Test screen display for the reduced pressure display module of FIG. 1.

The screen shown in FIG. 12 is a Post Cylinder Change Leak Test screen. The post cylinder change leak test is a rate of rise or "leak-up" test. The system is evacuated by the Local Evacuation procedure, using vacuum from the Pump/Scrubber, and then sealed and the pressure monitored for any upward change indicating a leak. As soon as the protocol is entered, automatic valve AV-15 opens and after a short delay, automatic valve AV-13 opens to evacuate the system. The vacuum level is measured by pressure transducer PT-11. After a brief stabilization delay, automatic valve AV-13 closes and the vacuum level is captured. At this point, the timer starts and runs for the time determined by the system set-up program. If the vacuum has not changed more than the set-up program allows, the system has passed the post change leak test.

Figure 13:
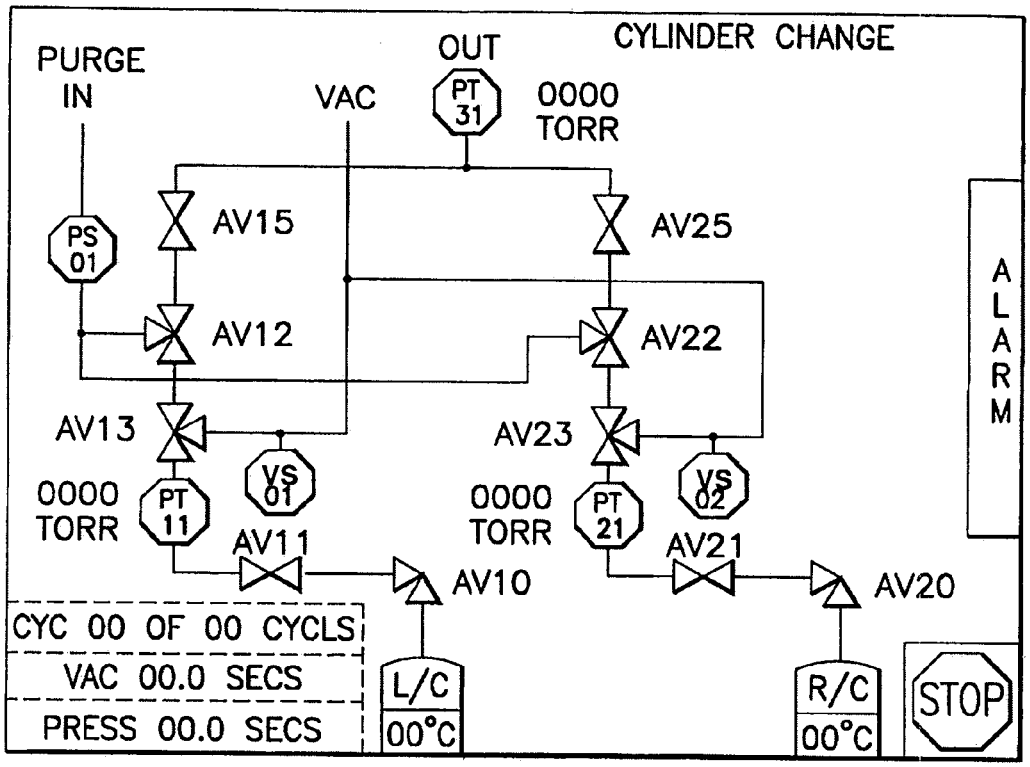
FIG. 13 is a Post Change Purge screen display for the reduced pressure module of FIG. 1.

When time for the leak test has expired, and the leak test timer has reached zero, the Post Change Purge screen appears, as shown in FIG. 13. The post-change cycle purge operation then commences its automated purge and evacuation routines. During the post-change purge, the cycle setpoint and current cycle count are displayed. Once the system has completed the preset number of evacuation and purge cycles according to the program, a screen will appear informing the operator that the cylinder change routine has been completed, whereupon the Enter button can be selected by the operator to return to the Main Menu.

Figure 14:
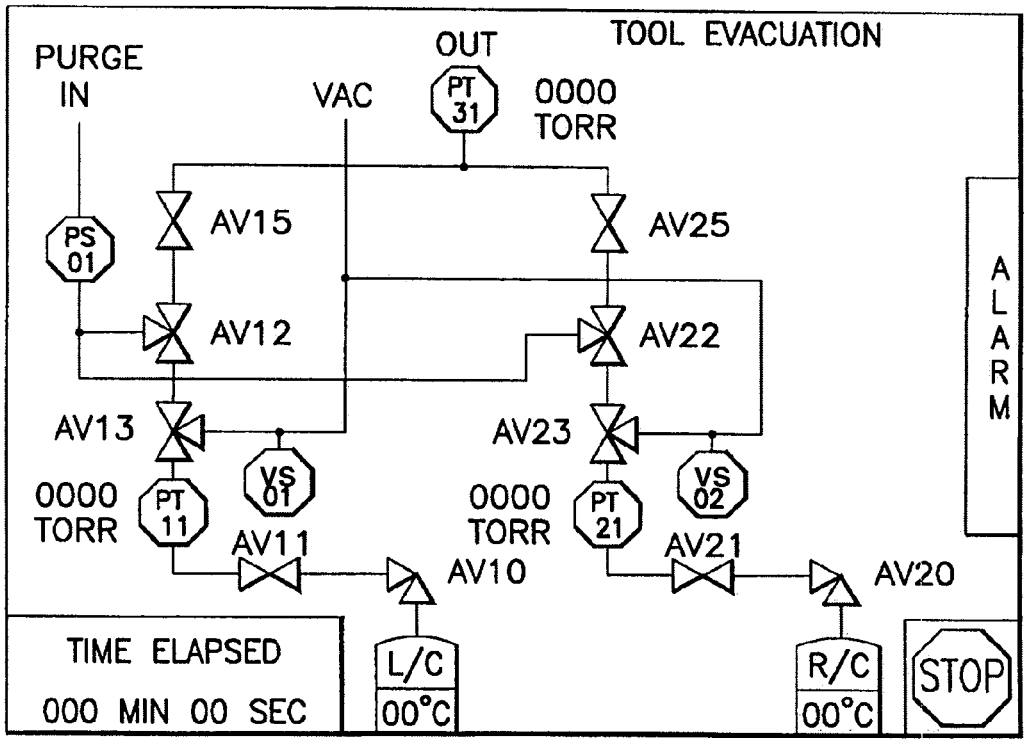
FIG. 14 is a "Tool Evacuation" screen diplay for the reduced pressure module shown of FIG. 1.

In order to carry out the tool evacuation operation, the appropriate gas supply vessel "CYLINDER MENU" is accessed, and the "TOOL EVACUATION" button is selected. This generates the screen shown in FIG. 14, and opens the tool isolation valve (AV-15 or AV-25) and evacuates the gas panel up to the cylinder valve (AV-10 or AV-20) using the vacuum system of the tool. If the tool vacuum is insufficient (less than the setpoint established in the set-up parameters), the tool isolation valve (AV-15 or AV-25) will not open and an alarm will activate. The "TOOL EVACUATION" operation remains in effect until terminated by the operator by pressing the "STOP" button at the lower right-hand portion of the screen.

Figure 15:
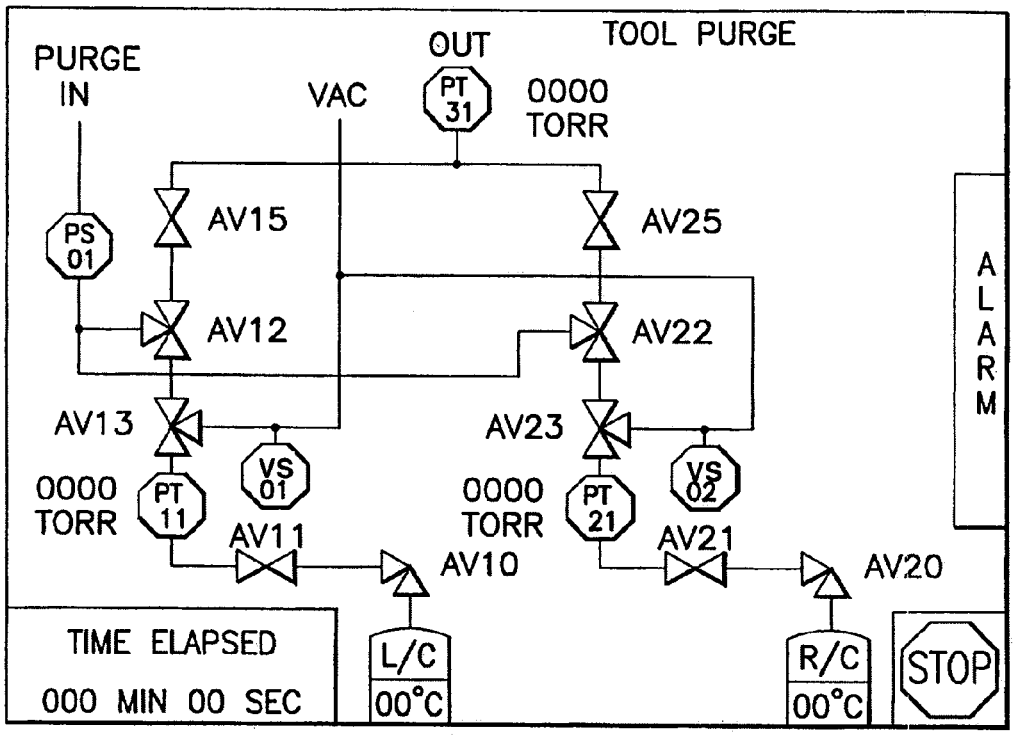
FIG. 15 is a "Tool Purge" screen display for the reduced pressure module of FIG. 1.

The "TOOL PURGE" menu next is selected from the appropriate gas supply vessel "CYLINDER MENU" to generate the screen shown in FIG. 15. The "TOOL PURGE" then commences, providing an inert gas purge from the purge inlet to the process tool by opening automatic valve AV-12 or AV-22, and by opening automatic valve AV-15 or AV-25. The minimum tool purge pressure set point (as established on the general setup screen, accessed by the screen sequence "MAIN MENU"→"MAINTENANCE MENU"→"OPERATING PARAMETERS") must be maintained at pressure transducer PT-31 for the purge to continue. The tool purge remains in effect until the operator presses the Stop button.

Figure 16:
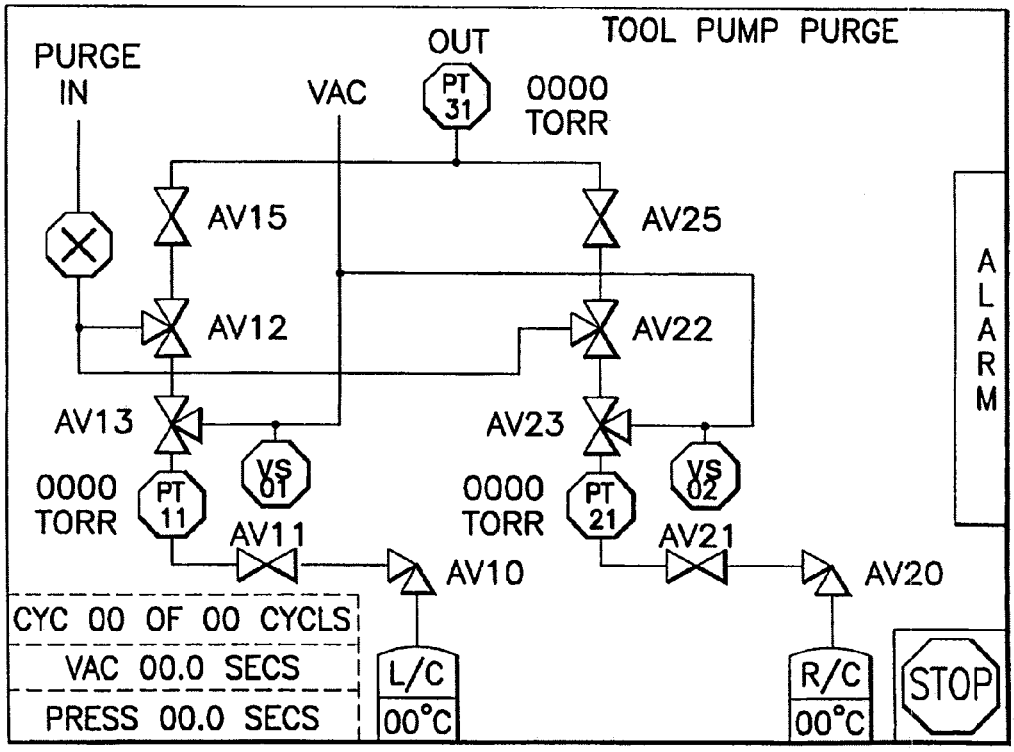
FIG. 16 is a "Tool Pump Purge" screen display for the reduced pressure module of FIG. 1.

Next, the tool pump purge operation is carried out, by selecting the "TOOL PUMP PURGE" menu from the appropriate gas supply vessel "CYLINDER MENU" to generate the screen shown in FIG. 16 and initiate the operation, during which the stick of the manifold is alternately evacuated and then pressurized with purge gas. Automatic valve AV-15 or AV-25 opens to evacuate the gas stick up to the cylinder valve, AV-10 or AV-20, using the vacuum system of the tool. The automatic valve AV-15 or AV-25 will not open unless the tool vacuum at pressure transducer PT-31 is below the minimum tool vacuum setpoint. Once the pressure at pressure transducer PT-11 or PT-21 is below the minimum vacuum level setpoint, a timer begins counting. When the timer counts out, automatic valve AV-015 or AV-25 closes, and automatic valve AV-12 or AV-22 opens to fill the manifold with purge gas. When the pressure at pressure transducer PT-11 or PT-21 is greater than the minimum purge setpoint, another timer begins counting and the system continues to purge until the timer reaches the number of cycles in the set-up. This two-part cycle is repeated for the programmed number of cycles and automatically ends by leaving the gas panel under vacuum.

Figure 17:
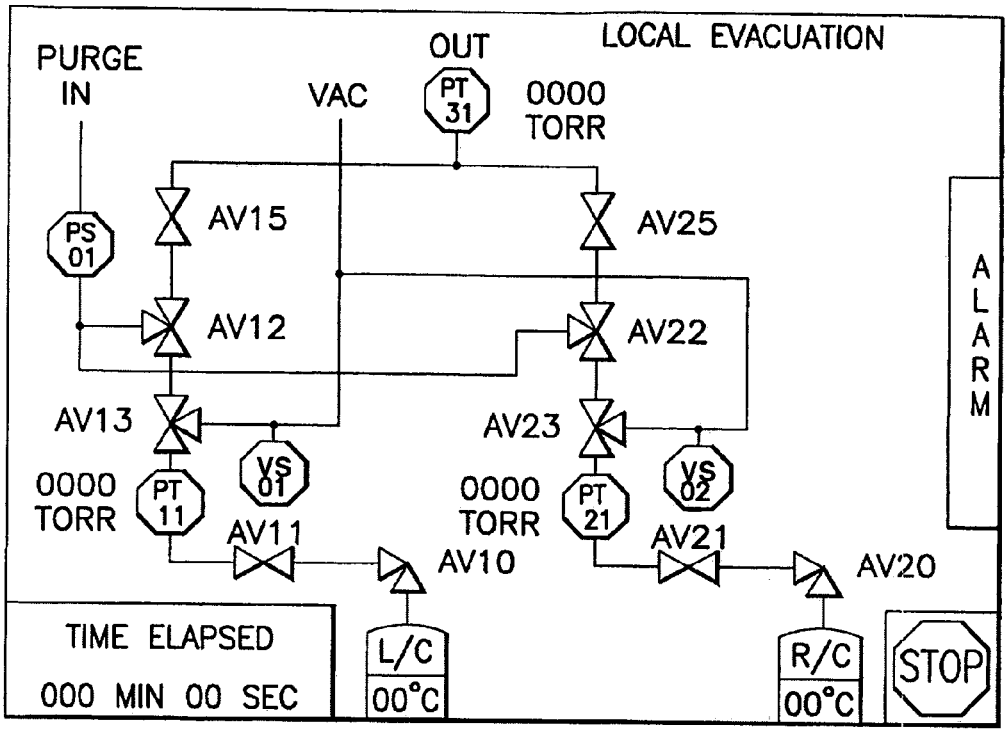
FIG. 17 is a "Local Evacuation" screen display for the reduced pressure module of FIG. 1.

The local evacuation operation then is carried out, by selecting the "LOCAL EVACUATION" menu from the appropriate gas supply vessel "CYLINDER MENU" to generate the screen shown in FIG. 17 and initiate the operation, to evacuate the gas stick using the vacuum supplied from the Pump/Scrubber. The presence of vacuum is verified at vacuum sensor VS-01 or VS-02, and automatic valve AV-13 or AV-23 is opened and the vacuum level is checked at pressure transducer PT-11 or PT-21. Once the vacuum level at PT-11 or PT-21 is below the minimum vacuum setpoint, automatic valve AV-11 or AV-21 is opened to evacuate the stick up to the cylinder valve. The local evacuation remains in effect until the operator presses the Stop button. During this operation, the gas cabinet is isolated from the tool and delivery line by closing the manual tool isolation valve.

Figure 18:
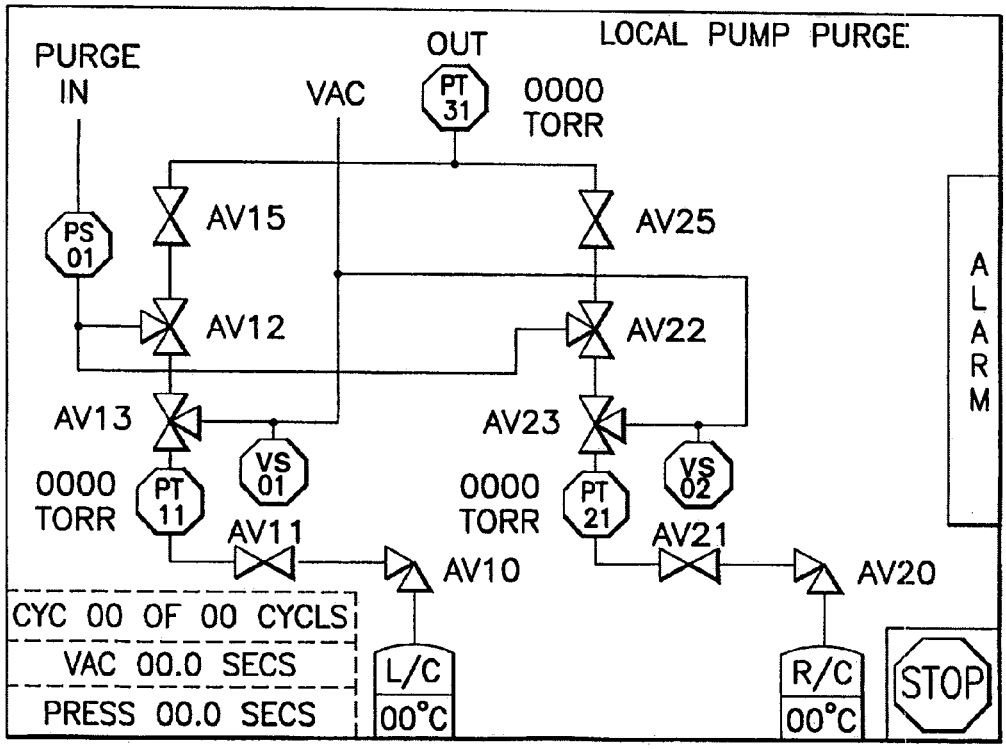
FIG. 18 is a "Local Pump Purge" screen display for the reduced pressure module of FIG. 1.

Next, the local pump purge operation is carried out, by selecting the "LOCAL PUMP PURGE" menu from the appropriate gas supply vessel "CYLINDER MENU" to generate the screen shown in FIG. 18 and initiate the operation, which begins by performing a "LOCAL EVACUATION" function as described hereinabove. When the vacuum level at pressure transducer PT-11 or PT-21 is below the minimum vacuum setpoint, the evacuation timer begins counting. When the timer counts out, automatic valve AV-13 or AV-23 closes, pressure sensor PS-01 checks that there is sufficient purge pressure, and automatic valve AV-12 or AV-22 opens to deliver purge gas to the stick. When the pressure at pressure transducer PT-11 or PT-21 is greater than the minimum purge pressure setpoint, the purge timer begins counting. When this timer counts out, the purge gas automatic valve AV-12 or AV-22 is closed and the venturi isolation valve AV-13 or AV-23 opens to evacuate the stick back to the cylinder valve. This sequence is repeated for the programmed number of cycles, automatically ending with evacuation of the manifold. During this sequence, the tool is isolated from the gas cabinet by closing the manual stick isolation valve.

The reduced pressure module can be operated in a manual mode by accessing the "MAINTENANCE MENU" and selecting "MANUAL CONTROL." In this mode, a screen is generated that depicts the gas panel, showing the valve states and the pressure readings for all transducers, and valve icons on the screen can be toggled to open or close the corresponding valves of the manifold.

Operating parameters can be established in the set up of the system by the screen sequence "MAIN MENU"→"MAINTENANCE MENU"→"OPERATING PARAMETERS," as described hereinabove. The operating parameters that are settable (with units denoted in parentheses) include the following:

General Setup

- Cylinder Low (Torr): point at which the system will warn the user that the cylinder is approaching empty and a replacement should be ordered.
- Cylinder Change-Over (Torr): point at which the system will warn the user that the cylinder is empty and switch to the back-up cylinder (if Auto Switchover is active).
- Minimum Tool Vacuum (Torr): The minimum vacuum that the system must detect from the tool.
- Balance Delay (Secs): the delay time to allow transducer reading stabilization.
- Vacuum Delta P (Torr): allowable reverse reading between transducers under vacuum.
- Cylinder Valve: select the type of valve on the cylinders being installed.

Tool Evacuate

- Minimum Tool Vacuum (Torr): the minimum vacuum that must be seen at pressure transducer PT-31 before valves will open in the tool evacuate and tool pump purge protocol.

Local Evacuate

- Minimum Vacuum Set Point (Torr): the minimum vacuum that must be seen at pressure transducer PT-11 or PT21 to allow Local Evacuate to continue.

Tool Pump Purge

- Vacuum Cycle Delay (Secs): time delay to allow the vacuum to stabilize.
- Minimum Purge Pressure (Torr): pressure that must be attained during the purge pressurization.
- Pressure Cycle Delay (secs): time delay to allow the pressure to stabilize.
- Minimum Tool Vacuum (Torr): The minimum vacuum that must be seen at pressure transducer PT-31 before valves will open during a tool pump purge.
- Number of Purge Cycles: number of pressure/vacuum cycles.

Local Pump Purge

- Minimum Vacuum Set Point (Torr): the minimum vacuum that must be attained by the vacuum source.
- Vacuum Cycle Delay (secs): time delay to allow the vacuum to stabilize.
- Minimum Purge Pressure at Pressure Transducer PT-11 or PT21 (Torr): purge gas pressure that must be attained.
- Pressure Cycle Delay (Secs): time delay to allow the pressure to stabilize.
- Number of Purge Cycles: number of pressure/vacuum cycles.

Cylinder Change

- Minimum Leak Test Pressure (Torr): the minimum pressure that must be attained during the leak-down test.
- Decay in Pressure Allowed (Torr): the loss of pressure that is allowed during the leak-down test.
- Pre-change Leak Test Time (Min): This is the leak test time at the beginning of a cylinder change to verify that the cylinder valve has been sealed properly.
- Pressure Transducer PT11/PT21 Minimum Pressure (Torr): the minimum pressure that must be attained during the cylinder change while the pigtail is disconnected.
- Minimum Leak Test Vacuum (Torr): the vacuum that must be attained to carry out the leak-up test.
- Rise in Pressure Allowed (Torr): This is the acceptable pressure rise allowed during the leak-up test.
- Post-Change Leak Test Time (min): This is the leak test time for the leak-up test after a new cylinder has been connected to verify that the CGA fitting has been tightened properly.
- Manifold Pressure Delay (Secs): pressure stabilization time before alarm.

The Pump/Scrubber connected with the reduced pressure module is adapted to provide the motive capability for effecting flow of gas through the manifold of the reduced pressure module, via the Pump component, and to transport the gas to the downstream tool or other gas-consuming process unit, or alternatively to flow the gas to the Scrubber component of the facility.

The Pump component can be of any suitable type, including a suitable device selected from among pumps, blowers, fans, compressors, ejectors, eductors, etc., as appropriate to the delivery and processing of gas in the facility in which the reduced pressure module and associated Pump component is employed. The Scrubber likewise can be of any suitable type, including wet scrubbers, dry scrubbers, mechanical scrubbers, oxidation scrubbers, etc.

Figure 19:
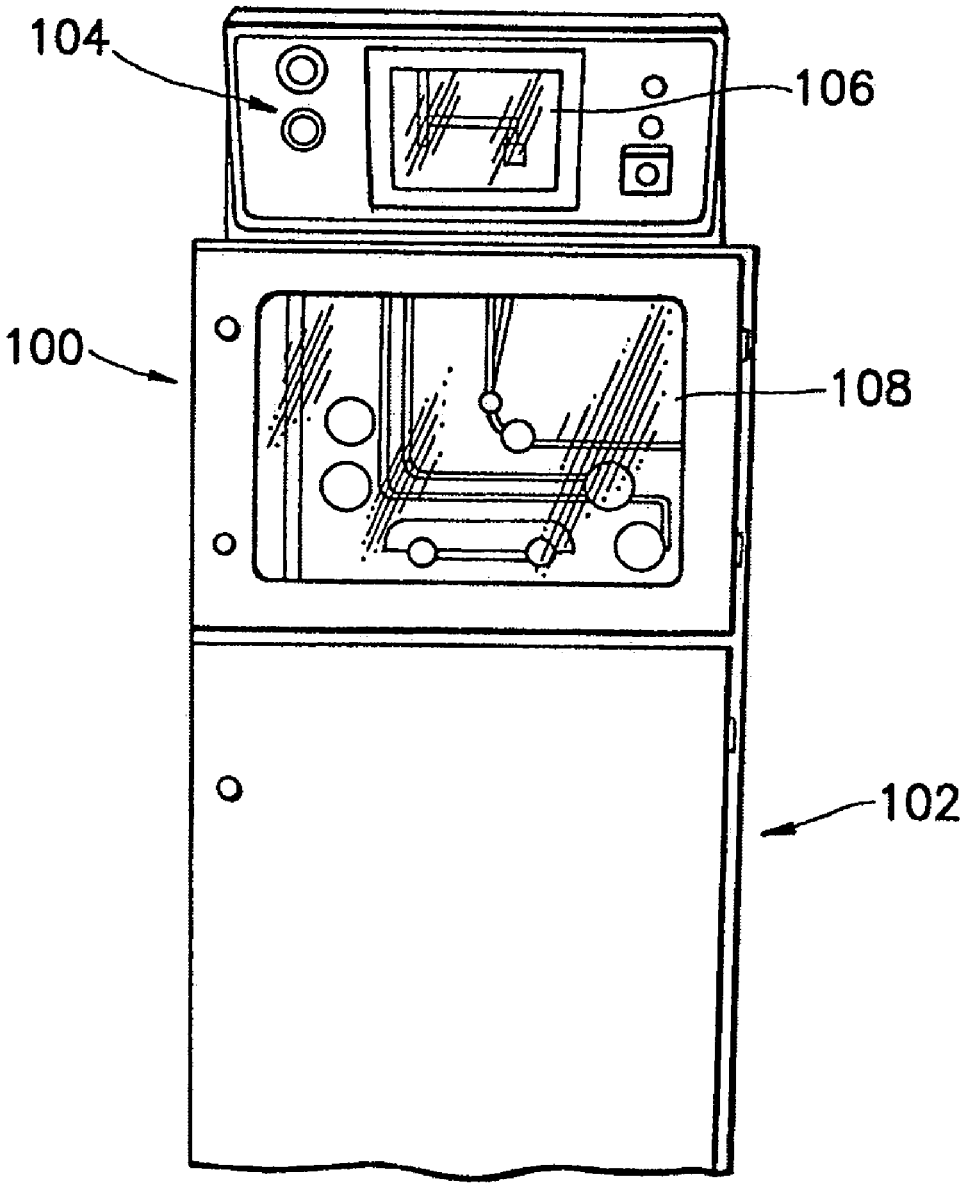
FIG. 19 is a front elevation view of an extractor module according to one embodiment of the invention, such as may be employed in combination with the reduced pressure module of FIG. 1.

The Pump component can also be a constituent of an extractor module 100 as shown in FIG. 19, which may comprise a pump and a surge tank (not shown in FIG. 19; see FIG. 20, described more fully hereinafter), along with controls and safety systems appropriate for safe operation. The extractor system components may be housed in an exhausted and monitored enclosure, with the gas delivery hardware being housed in a main cabinet 102 equipped with viewing window 108, and with associated control electronics being located in a separate enclosure 104 mounted on the top of the main cabinet 102, in a manner generally analogous to the hardware and electronics arrangement of the reduced pressure monitor as described hereinabove.

The extractor system extracts the gas from the reduced pressure module and boosts the pressure to a constant level for downstream gas-consuming tools operating at mild vacuum pressure, with the pumping system operating automatically to maintain a constant sub-atmospheric pressure in the surge tank regardless of flow rate of gas. Evacuation and purging of the extractor system are done manually, since no routine shut-down is required (as in a gas cabinet in which gas cylinders must be changed periodically).

A programmable logic controller (PLC) and companion color touch screen 106 provide preprogrammed functionality and local indication of valve status and system pressures. Surge tank pressure control is achieved through control of the pump speed.

Figure 20:
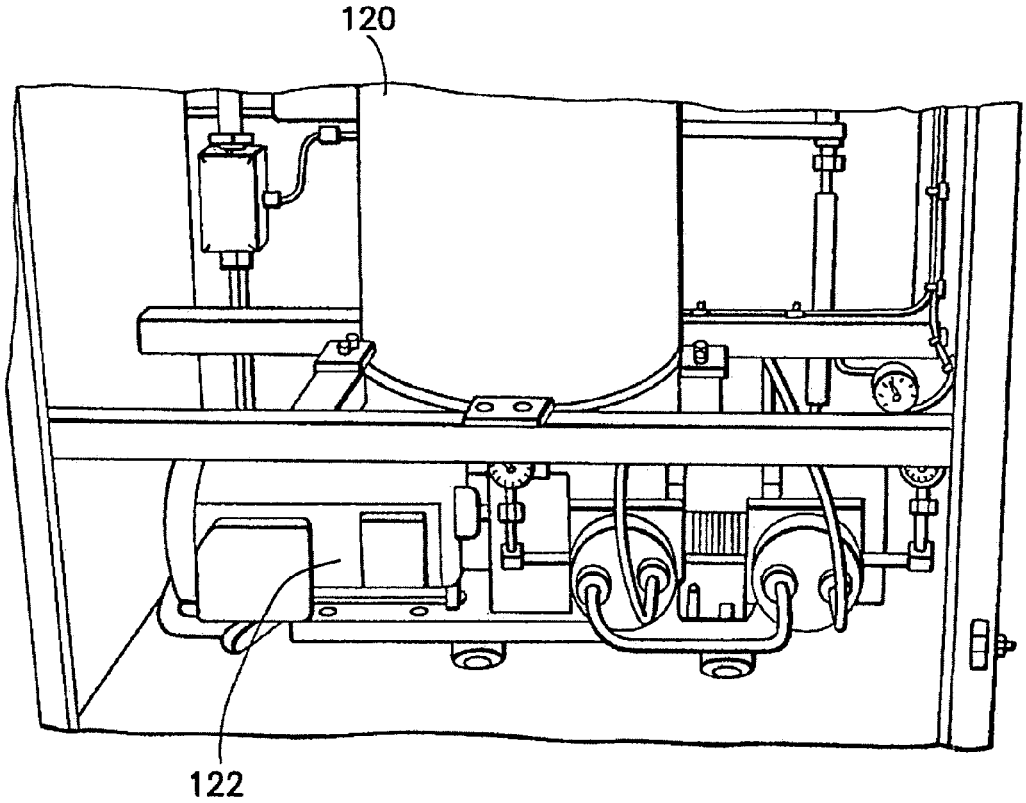
FIG. 20 is a front view of a portion of the extractor module of FIG. 19, showing the surge tank and extractor pump components thereof.

The main cabinet 102 thus constitutes a pumper cabinet that encloses a surge tank 120 and an extractor pump 122, as shown in FIG. 20, process plumbing and the purge and vent plumbing and is monitored for exhaust pressure. The surge tank can be of any suitable volume, e.g., from about 25 liters to about 150 liters, as appropriate to the specific gas delivery operation involved. The window 108 in the upper door of the main cabinet 102 is a fire-rated safety glass window to allow visual inspection of the condition of the manifold prior to opening the door. The doors are suitably secured with manual twist latches. The color touch screen interface 106, EMO (Emergency Machine Off) button and the START button are located on the front of the electrical enclosure 104 on top of the main cabinet 102.

The pump speed control of pump 122 is accommodated by a proportional integral derivative (PID) control loop in the programmable logic controller (PLC) of the extractor module. The PLC compares the surge tank pressure in surge tank 120 to a set point, and generates a voltage output that is fed to a variable frequency drive (VFD), which in turn controls the speed of the pump motor by varying the frequency fed to the three-phase motor. As the flow requirement increases or as the inlet pressure decreases, the pump speed will increase proportionally to maintain a constant pressure in the surge tank.

Figure 21:
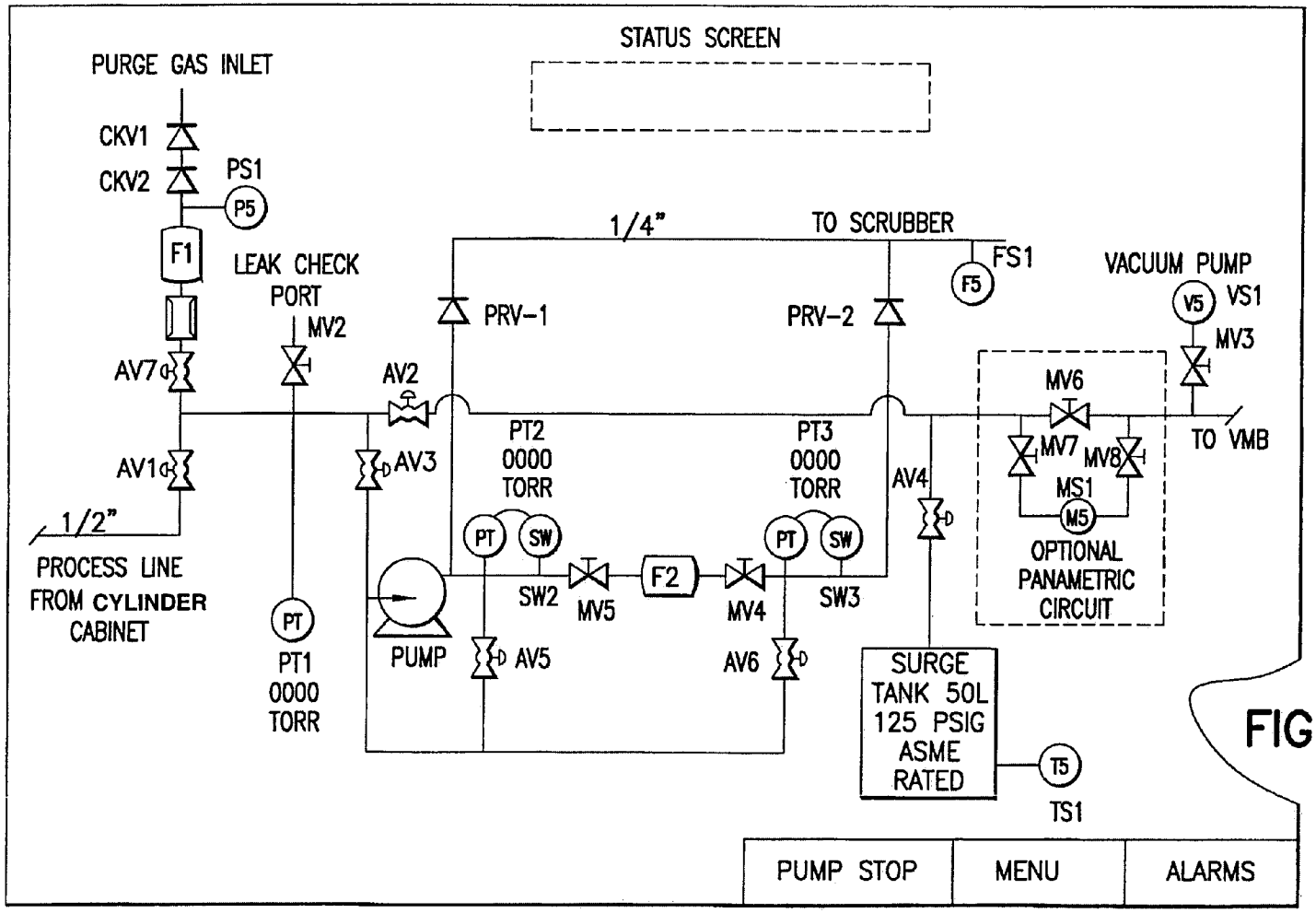
FIG. 21 is a "Status Screen" for the extractor module of FIG. 19, showing the flow circuitry of the manifold in the extractor module, and the components of the extractor module.

FIG. 21 shows an illustrative Status Screen for the extractor module. The Status Screen displays the status of all valves, which as in the reduced pressure module may be color-coded or otherwise visually perceptible as to state (e.g., being displayed in red for closed and in green for open), the pressure reading of each pressure transducer, the temperature in the surge tank, the state of the pressure switches, and the status of the pump (ON or OFF).

FIG. 21 thus shows the flow circuitry of the manifold in the extractor module, and the components of the module, as including a leak test port F1 ("Leak Check Port") which is closed off by manual valve MV-2. Three pressure transducers are located on the manifold: PT-1 monitors the pressure at the system inlet; PT-2 monitors the pump outlet pressure; PT-3 monitors the surge tank pressure, which is also the outlet pressure to the downstream process tool. During the purging of the manifold, the incoming purge gas pressure is monitored by pressure switch PS1. The vacuum level (from a Pump/Scrubber or other vacuum source) is monitored by vacuum sensor VS-1. The gas temperature at the inlet to the surge tank is monitored by thermocouple TS-1. If either of the pressure relief valves PRV-1 or PRV-2 should open, flow detector FS-1 will direct flow to the scrubber.

The extractor module employs a "MAIN MENU" in an analogous fashion to the reduced pressure module, with the "MAIN MENU" displaying touch selections including "ACCESS MENU," "ALARMS," "ALARM HISTORY," "SYSTEM STATUS," "PUMP CONTROL," "UNIVERSAL MENU" and "SYSTEM IDLE."

Figure 22:
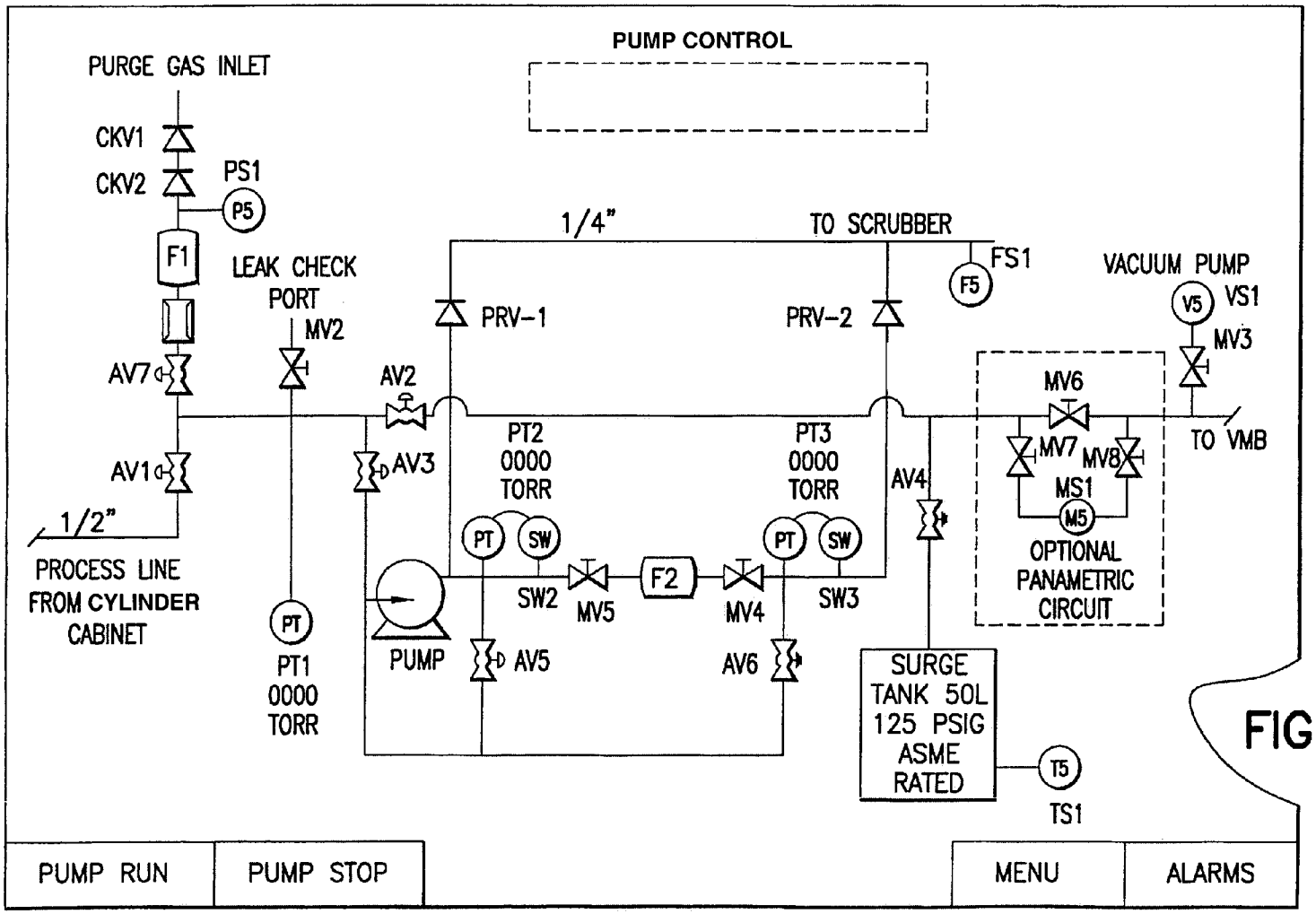
FIG. 22 is a "Pump Control" screen display for the extractor module of FIG. 19.

To start the pump, the operator selects "PUMP CONTROL" from the "MAIN MENU" to generate the screen shown in FIG. 22, and the "Pump Run" selection is made on the screen. If the pressure in the surge tank is below the set point (e.g., ~600 Torr), the pump will turn on to bring the pressure up to the set point. A screen display will then appear, directing the operator to open the manual valve (not shown in FIG. 22, but which is disposed in the "TO VMB" (Valve Manifold Box) line shown at the right-hand portion of the drawing), in order to open the flow path of the system to the downstream process tool. After the operator confirms that the manual valve is open, and that the gas delivery operation should commence, the pneumatic outlet block valve AV-4 is opened by the system to effect gas flow to the tool. To turn off the pump, the "Pump Stop" selection is made on the Pump Control screen shown in FIG. 22. The system will then stop the pump and isolate the system by closing valves AV-1 and AV-4.

The extractor module is also selectively actuatable to carry out evacuation and purging operations, involving valves MV-3, AV-1, AV-2, AV-3, AV-4 and AV-7. A manual mode of operation is also accommodated by the system.

Operating parameters can be established in the set up of the extractor module by the screen sequence "MAIN MENU"→"MAINTENANCE MENU"→"OPERATING PARAMETERS." The operating parameters that are settable (with units denoted in parentheses) include the following:

Operating Parameters

- PT-1 Set Point (Torr): pressure above which the system will not allow the inlet block valve AV-1 to open.
- PT-2 Set Point (Torr): pressure at which the system will warn the user that the system is above atmospheric pressure.
- PT-3 Set Point (Torr): pressure above which the system will shut off the pump.
- PT-2/3 Delta (Torr): looks at the pressure drop across the particle filter to determine if the filter is becoming plugged.

Figure 23:
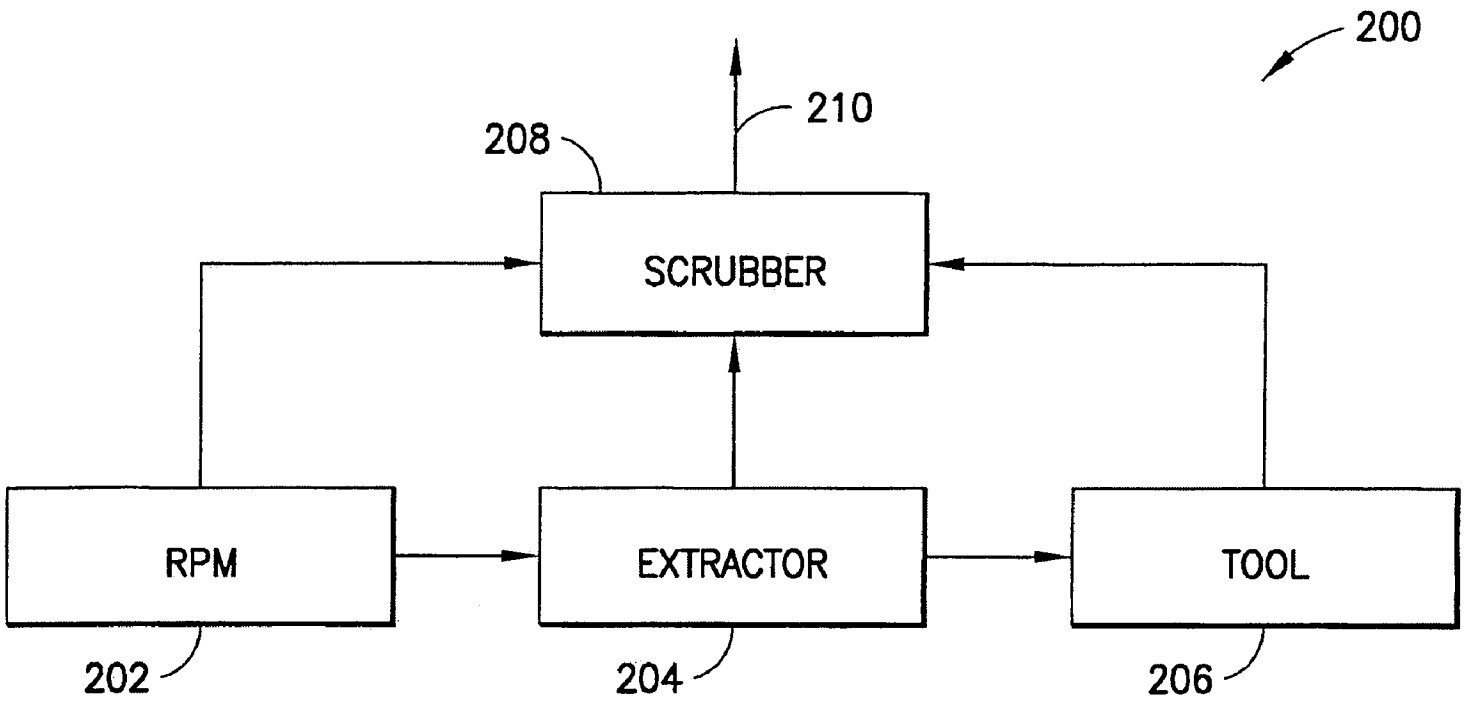
FIG. 23 is a schematic block diagram of an integrated semiconductor manufacturing facility showing the reduced pressure module (RPM) joined in gas flow communication with an extractor module (EXTRACTOR) which in turn is coupled in gas flow communication with a semiconductor manufacturing gas-consuming unit (TOOL), with each of RPM, EXTRACTOR, and TOOL being joined in exhaust relationship with scrubber unit (SCRUBBER).

FIG. 23 is a schematic block diagram of an integrated semiconductor manufacturing facility 200 showing the reduced pressure module (RPM) 202 joined in gas flow communication with an extractor module (EXTRACTOR) 204 which in turn is coupled in gas flow communication with a semiconductor manufacturing gas-consuming unit (TOOL) 206, with each of RPM 202, EXTRACTOR 204, and TOOL 206 being joined in exhaust relationship with scrubber unit (SCRUBBER) 208 for abatement of the toxic/hazardous gas species in the gas flowed to the SCRUBBER from the RPM, EXTRACTOR and/or TOOL, and final discharge of the treated effluent from the scrubber in discharge line 210.

In accordance with the present invention, the addition of a time delay to the auto-switchover action in the reduced pressure module allows the extractor cabinet to be warned in advance of the auto-switchover taking place. The extractor cabinet then can take action to prevent the introduction of a pressure spike to the inlet of the fast running extractor pump. The reduced pressure module and extractor module are programmatically arranged in their respective electronics modules, to carry out the sequence of steps identified in FIGS. 24A and 24B.

The time delay auto-switchover sequence of the invention is initiated when the gas supply vessel that is actively dispensing gas for flow to the downstream extractor module reaches its empty or endpoint limit. Such limit, marking the end of the useful dispensing operation of the on-stream gas supply vessel, may be demarcated by any suitable means and/or method. For example, the empty/endpoint limit may be demarcated by a specific weight of the vessel approaching its tare weight, indicating that the contained gas is depleted to a desired degree for change-over to a fresh gas supply vessel. As another alternative, the empty/endpoint limit may be a set point determined by a cumulative time of dispensing operation. As yet another alternative, the empty/endpoint limit may be determined by a diminution of pressure and/or flowrate of the dispensed gas, to a level indicative that the gas supply vessel is approaching or at empty status. Any other approaches, e.g., rate of change of one or more characteristics of the dispensed gas, may be employed to establish or detect an end-stage limit to the gas dispensing operation involving the on-stream gas supply vessel.

Regardless of how determined, the empty/endpoint limit when reached is sensed (Step 1 in FIG. 24A), e.g., by a weight sensor, pressure transducer, flowrate sensor, volumetric (cumulative) flowmeter, cycle timer, etc., as appropriate to the specific mode of determination of the limit point, and a limit sensing signal is generated in the electronics circuitry of the reduced pressure module, which is programmably arranged with the electronics circuitry of the extractor module to effect the time delay auto-switchover sequence. The limit-sensing signal then is transmitted in the electronics enclosure of the reduced pressure module to a closable contact, relay or other actuatable means, to induce switching of such means to a switched condition indicative of the limit sensing. For example, in the sequence illustrated in FIG. 24A, the contact is closed (Step 2).

Figure 24A:
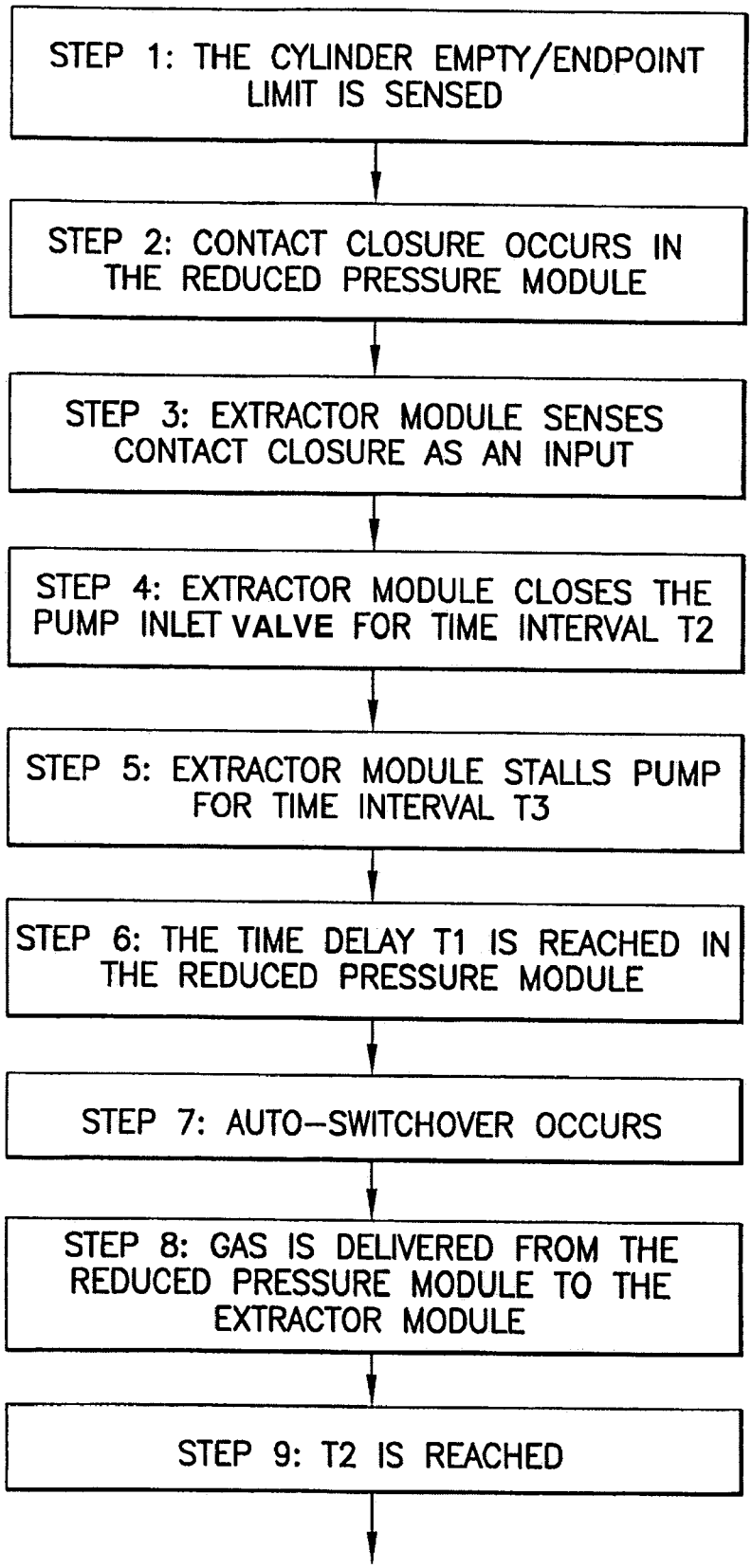
FIG. 24A and FIG. 24B show a process flow diagram including steps involved in a time delay auto-switchover sequence according to one embodiment of the invention.
Figure 24B:
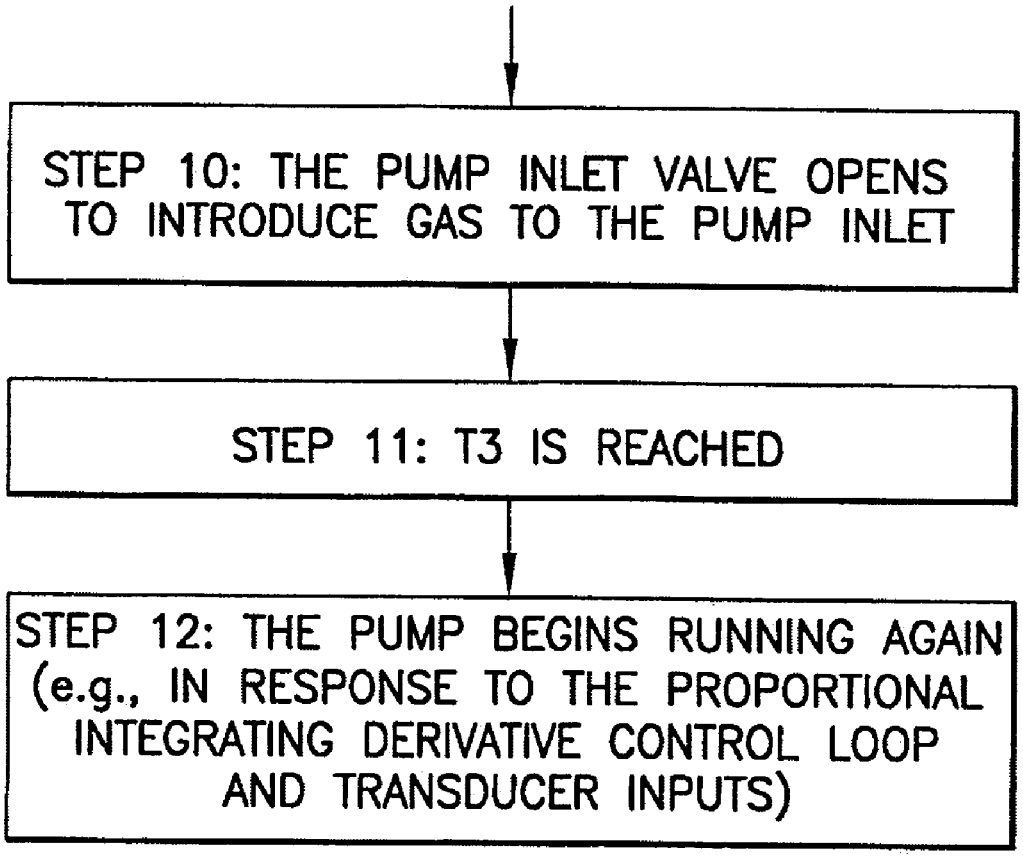

The extractor module then senses the contact closure in the reduced pressure module as an input (Step 3 in FIG. 24A). Such input may be effected by a current signal transmitted from circuitry including the closed contact in the reduced pressure module to the control circuitry in the electronics compartment of the extractor module. The control circuitry in the electronics compartment of the extractor module then responsively operate to close the pump inlet valve (valve AV-3 as shown in FIGS. 21 and 22) for a time interval that is denoted in FIG. 24A as time T2 (Step 4). Concurrently, the extractor module control circuitry stalls the pump, e.g., by switching off the power to the variable frequency drive (VFD) for such pump, for a time interval that is denoted in FIG. 24A as time T3 (Step 5).

The closing of the closable contact in the reduced pressure module also actuates a timer in the electronics circuitry of such module. The timer is actuated to count down a time delay interval denoted in FIG. 24A as time T1, until the time delay interval T1 has been reached (Step 6). At this point, auto-switchover of the gas supply vessels in the reduced pressure module takes place (Step 7), to switch the flow of dispensed gas from the exhausted gas supply vessel to a fresh (gas-filled) gas supply vessel, to ensure continuity of gas dispensing operation.

Gas then is flowed from the fresh gas supply vessel in the reduced pressure module to the extractor module (Step 8) and such flow continues until the pump inlet valve closure time interval T2 has been reached, which may be determined by a time that is actuated in the electronics circuitry of the extractor module at the beginning of Step 4. When the pump inlet valve closure time interval T2 has been reached (Step 9), the pump inlet valve (AV-3 as shown in FIGS. 21 and 22) opens to introduce gas to the pump inlet (Step 10). Such actuation of the pump inlet valve may be effected by operatively coupling the timer with a pneumatic actuator for the pump inlet valve, so that the timer on reaching time interval T2 actuates a switch to initiate gas flow to the pneumatic actuator for the pump inlet valve.

Gas then continues to flow from the reduced pressure module to the pump in the extractor module, until the pump inactivation time interval T3 is reached (Step 11). At this point, the pump is actuated to resume running. The pump inactivation time interval T3 may be dynamically programmably established by a proportional integrating derivative (PID) control loop in the electronics circuitry of the extractor module which is operatively coupled with pressure transducers in the extractor module, so that the resumption of pump operation is "smoothed" in relation to pressures in the manifold gas flow circuitry of the extractor module to minimize pressure and flow rate perturbations in the flow circuitry and to eliminate the pressure spikes that are characteristic of operation of the prior art system in the absence of the time delay auto-switchover sequence of the invention. The PID control loop for such purpose may be operatively coupled with the variable frequency drive (VFD) of the pump, to energize the VFD in reinitiation of the pump operation. Alternatively, the time interval T3 can be set by a timer in the auto-switchover system.

The foregoing time delay auto-switchover sequence of the invention has been illustratively described above in reference to a reduced pressure module in combination with an extractor module. It will be recognized, however, that the invention is not thus limited, but rather may be practiced with any multiple vessel array in which a downstream pump or other motive fluid driver is susceptible to pressure spikes at the pump outlet in response to substantial pressure variation at the pump inlet incident to switchover of gas supply from one vessel to another in the multiple vessel array. Further, although the invention has been illustratively described in reference to a two-vessel array, it will be recognized that the invention is amenable to implementation in multiple vessel arrays including more than two gas supply vessels. Finally, while the invention has been described with reference to specific circuitry and control elements and relationships herein, it will be recognized that the general methodology of the invention as illustratively set out and described with reference to FIGS. 24A and 24B hereof can be implemented in any of numerous hardware/software configurations and formats.

It will be appreciated that the apparatus and method of the invention may be practiced in a widely variant manner, consistent with the broad disclosure herein. Accordingly, while the invention has been described herein with reference to specific features, aspects, and embodiments, it will be recognized that the invention is not thus limited, but is susceptible of implementation in other variations, modifications and embodiments. Accordingly, the invention is intended to be broadly construed to encompass all such other variations, modifications and embodiments, as being within the scope of the invention hereinafter claimed.

What is claimed is:

1. A gas supply and dispensing system, comprising:

an array of at least two gas storage and dispensing vessels arranged for sequential on-stream dispensing operation involving switchover from a first vessel to a second vessel in the array;

a pump coupled in gas flow communication between the array and a gas-consuming process unit for pumping of gas derived from an on-stream one of the vessels in the array to the gas-consuming process unit; and an auto-switchover system constructed and arranged to sense a switchover setting and to initiate auto-switching from the on-stream one of the vessels to another of the vessels in the array having gas therein, for subsequent dispensing of gas from said another of the vessels, as a subsequent on-stream vessel, wherein the auto-switchover system between sensing of the switchover setting and initiating auto-switching terminates flow of gas to the pump and inactivates the pump; and wherein the auto-switchover system after initiating auto-switching reinitiates flow of gas to the pump and reactivates the pump.

2. The system of claim 1, wherein the switchover setting enables toggling back and forth between the at least two gas storage and dispensing vessels.

3. The system of claim 1, wherein the auto-switchover system comprises a timer.

4. The system of claim 1, wherein the auto-switchover system is constructed and arranged to terminate flow of gas to the pump prior to inactivating the pump.

5. The system of claim 1, wherein the gas comprises a semiconductor manufacturing gas, and the gas-consuming process unit comprises a semiconductor manufacturing tool.

6. The system of claim 1, wherein the gas storage and dispensing vessels are disposed in a gas cabinet.

7. The system of claim 6, wherein the gas storage and dispensing vessels are coupled in gas flow communication to a valved manifold in the gas cabinet.

8. The system of claim 1, wherein the gas supply and dispensing system further comprises hardware and electronics constructed and arranged for automated or manual evacuation, purging and leak detection of the array.

9. The system of claim 1, wherein the gas supply and dispensing system further comprises a programmable logic controller (PLC) for providing preprogrammed sequences for control of a function selected from the group consisting of: vessel change-out, gas flow initiation, auto-switchover of vessels, purge gas control, process/purge gas evacuation, securing process gas flow followed by shut-down, and temperature control.

10. A method of substantially reducing pressure variation of pumped gas discharged from a pump in a gas supply and dispensing system comprising an array of at least two gas storage and dispensing vessels arranged for sequential on-stream dispensing operation involving switchover from a first vessel to a second vessel in the array, wherein the pump is coupled in gas flow communication between the array and a gas consuming process unit for pumping of gas derived from an on-stream one of the vessels in the array to the gas-consuming process unit, said method comprising:

sensing a switchover setting and initiating auto-switching from the on-stream one of the vessels to another of the vessels in the array having gas therein, for subsequent dispensing of gas from said another of the vessels, as a subsequent on-stream vessel, terminating flow of gas to the pump and inactivating the pump, wherein said terminating and inactivating steps are conducted between the step of sensing the switchover setting and the switching step; and reinitiating flow of gas to the pump and reactivating the pump, wherein said reinitiating and reactivating steps are conducted after the switching step.

11. The method of claim 10, wherein the switchover setting enables toggling back and forth between the at least two gas storage and dispensing vessels.

12. The method of claim 10, wherein the switchover setting comprises a timer.

13. The method of claim 10, comprising terminating flow of gas to the pump prior to inactivating the pump.

14. The method of claim 10, comprising reinitiating flow of gas to the pump prior to reactivating the pump.

15. The method of claim 10, wherein said gas comprises a semiconductor manufacturing gas, and the gas-consuming process unit comprises a semiconductor manufacturing tool.

16. The method of claim 10, wherein the gas storage and dispensing vessels are disposed in a gas cabinet.

17. The method of claim 16, wherein the gas storage and dispensing vessels are coupled in gas flow communication to a valved manifold in the gas cabinet.

18. The method of claim 10, wherein the gas supply and dispensing system further comprises hardware and electronics constructed and arranged for automated or manual evacuation, purging and leak detection of the array.

19. The method of claim 10, wherein the gas supply and dispensing system further comprises a programmable logic controller (PLC) for providing preprogrammed sequences for control of a function selected from the group consisting of: vessel change-out, gas flow initiation, auto-switchover of vessels, purge gas control, process/purge gas evacuation, securing process gas flow followed by shut-down, and temperature control.

20. A method of manufacturing a semiconductor device comprising supplying a gas to a semiconductor manufacturing tool from the gas supply and dispensing system of claim 1.

* * * * *